US006663331B1

(12) United States Patent
Mori et al.

(10) Patent No.: US 6,663,331 B1
(45) Date of Patent: Dec. 16, 2003

(54) RING OPENING AND CLOSING BAR AND BINDING APPARATUS USING THE SAME

(75) Inventors: Makoto Mori, Katsushika-ku (JP); Miki Horita, Katsushika-ku (JP); Yasuhiro Tokita, Katsushika-ku (JP)

(73) Assignee: Carl Manufacturing Co., Ltd., Tokyo (JP)

( * ) Notice: Subject to any disclaimer, the term of this patent is extended or adjusted under 35 U.S.C. 154(b) by 194 days.

(21) Appl. No.: 09/657,802

(22) Filed: Sep. 8, 2000

(30) Foreign Application Priority Data

Oct. 29, 1999 (JP) ..... 11-309496
Jul. 21, 2000 (JP) ..... 2000-221295

(51) Int. Cl.[7] ..... B42B 5/10

(52) U.S. Cl. ..... 412/39; 281/29; 402/4; 402/57; 402/73; 412/9; 412/15; 412/42

(58) Field of Search ..... 412/9, 15, 38, 412/33, 39, 40, 42; 402/57, 4, 26, 31, 35, 36, 38, 73, 79, 80 L, 80 R; 281/29, 31; 229/67.1

(56) References Cited

U.S. PATENT DOCUMENTS 4,758,125 A * 7/1988 Wahl ..... 412/39
5,197,842 A * 3/1993 Bross ..... 412/39
6,000,895 A * 12/1999 Maes ..... 402/57

FOREIGN PATENT DOCUMENTS

| | | | |
|---|---|---|---|
| DE | 2362440 | * | 6/1974 |
| EP | 0529881 | * | 3/1993 |
| JP | 2001-191678 | * | 7/2001 |

* cited by examiner

*Primary Examiner*—Monica Carter
(74) *Attorney, Agent, or Firm*—Oliff & Berridge, PLC

(57) ABSTRACT

A rectangular opening/closing bar is formed, which is inserted in the curl ring of the ring binder to bind papers. The tip end of the opening/closing bar 28A is provided with an instruction portion 28*a* to raise and open ring pieces in turn while inserting the opening/closing bar 28A. Further, the opening/closing bar may have swollen portions on both ends of the opening/closing bar 28A to enable the bar slide smoothly in the curl ring. And it may be provided with a guide plate 28D perpendicular to the side wall 28*b* of the opening/closing bar 28A of the swollen portions side. In order to enhance the workability of the opening/closing bar, it may be preferable to use an auxiliary device for positioning the ring binder.

11 Claims, 39 Drawing Sheets

RING OPENING AND CLOSING BAR AND BINDING APPARATUS USING THE SAME

BACKGROUND OF THE INVENTION

1. Field of the Invention

The present invention relates to a ring opening and closing bar to open and close easily a curl ring of a ring binder for binding papers and the like and a binding apparatus consisting of the ring binder, the opening and closing bar and the auxiliary devices for setting and positioning papers.

2. Related Art

Conventionally, when binding a given size of plastic plates, papers 1, such as shown in FIG. 43, standard size of A4 or B5 (standard papers), a ring binder 3 having a curl ring 2 has been used. The ring binder 3, as shown in FIG. 44, is constituted from a longitudinal base portion 3A formed semi-circular in section perpendicular to the longitudinal direction of the base portion 3A and a plurality of ring pieces 2*a* which are extended from one side of the base portion 3A and curved circularly along the semi-circular base portion 3A to contact and overlap the other side of the base portion 3A. The tip ends of these ring pieces 2*a* are formed tapered.

When binding the papers 1 by the ring binder 3, the curl ring 2 is opened using a paper binding apparatus 4 and holes 5 of the papers 1 are fitted by the curl ring 2.

An explanation of a conventional curl ring 2 of a ring binder 3 will be carried out by showing how to open the curl ring. As shown in FIG. 44, on a putting portion 6 for papers 1 and the like, a binder setting portion 7 for setting a ring binder 3 is provided. Raised pawls 9 are provided at a regular spacing apart from and in parallel with a wall face 8 is extended laterally at an intermediate portion of each raised pawl 9.

Further, under the raised pawls 9 a movable plate 11 able to be displaced horizontally is provided and on the end of the movable plate, reversely L-letter shaped pawls 1 are raised at a regular spacing. The pawls 12 are arranged in such a manner as those are overlapped with the projection 10 horizontally.

Above the setting portion 6 a paper holding portion 3 for holding the papers 1 and the like is provided turnably outside. This paper holding portion 13 is functionally in association with the movable plate 11, and when the paper holding potion 13 is closed inside, the movable plate 11 is pushed out, and it is retracted when the paper holding portion 13 is opened outside. That is, by a movement of the movable plate 11 in a A direction, the raised pawls 9 and the reversely L-letter shaped pawls 12 are adapted to come close and be separated.

In FIG. 44, a sigh 14 represents a cover covering above the binder setting portion 7.

Further, a sign 15 represents a guide plate with a positioning step 16 for being used when punching a hole 5 in the papers 1 by the paper binding apparatus 4. The guide plate 15 is mounted rotatably on the putting portion 6. In addition, on opposing faces of the putting portion 6 and the paper holding portion 13, magnets 17 for clamping the positioned papers 1 are provided.

And, when binding the papers 1, the cover 14 and the paper holding portion 13 are opened and the raised pawls 9 and the reversely L-shaped pawls 12 are adjusted, the base portion 3A of the ring binder 3 is disposed in a binder setting portion 7, that is between the wall face 8 and the raised pawls 9 and the curl ring 2 is disposed in such manner as the curl ring 2 is located between adjacent raised pawls 9.

Further, the ring binder 3 is displaced laterally in such a manner as the projections 10 and the reversely L-shaped pawls 12 are inserted in the curl ring 2 and the paper holding portion 13 is closed inside, thereby the movable plate 11 is pushed out, as shown in FIG. 45, the reversely shaped pawls 12 are pushed out forward. Whereas, the pawls 2*a* of the curl ring 2 are removed from the other end of the base portion 3A. In that state, the holes 5 of the papers 1 are coincided with the positions of the pawls 2*a* of the curl ring 2, that is, enabling to be inserted, the paper holding portion 13 is returned, that is, opened, the pawls 12 are retracted with the movable plate 11 and the curl ring 2 is closed to finish the binding of the papers 1.

For reference, if the holes 5 are not punched in the papers 1, as shown in FIG. 46, with the above paper binding apparatus 4 or a punch 18 the holes 5 can be punched. In this case, as shown in FIG. 44, the paper holding portion 13 is raised and the papers 1 are put on the above the putting portion to abut the ends of the papers 1 against the positioning step 16 of the guide plate 15, then the paper holding portion 13 is closed as shown in FIG. 46. At that time the magnets 17 clamps the papers 1 magnetically to prevent the papers 1 from moving. Subsequently, the guide plate 15 is turned reversely toward a back side of the putting portion 6 for avoiding the punch 18 from touching the guide plate 15 and while abutting a projection 20 provided on the center of the punch 18 against a concave portion 19 provided on the center of the paper holding portion 13 the papers 1 are punched in turn.

In a conventional binding-apparatus 4, since the base portion 3A of a ring binder 3 is adjusted to the raised pawls 9 provided on a binder putting portion 7, the curl rings 2 are adjusted on the reverse L-letter pawls 12 provided on the movable plate 11 and the ring pieces are made to be opened and closed by opening and closing the paper holding portion 13 together with the to and fro moving of the movable plate 11, a structure for opening the ring binder 3 is complicated to invite a higher cost. Further, when opening the curl rings, while displacing the ring binder 3 laterally in such a manner as the reverse L-letter pawls 12 and the projections 10 are adjusted and in that state the paper holding portion 13 has to be closed, so that the operation becomes complicated. As mentioned above, in order to open the curl rings 2 of the ring binder 3, a large scaled devices have been necessitated, so that a more efficiently-operational and simple opener for curl rings has been requested to be developed.

The present invention has been made in the light of such circumstances, a purpose thereof is to provide a ring opening/closing tool and a binding apparatus avoiding a complicated operation and pursuing a low cost.

As a solving means of the above problem, a first aspect of the present invention is characterized in an rectangular opening/closing bar is formed for being inserted in the curl ring and a introduction portion is provided on the tip of the opening/closing bar for guiding the bar in the curl ring.

According to the first aspect of the present invention, a rectangular opening/closing bar is formed, and on a tip end portion of the opening/closing bar an introduction portion is formed and when this opening/closing bar is inserted in a curl ring and a base portion of the ring binder, ring pieces are pushed up in turn by the introduction portion to be opened. Thus, when the curl rings are opened, ends of a plurality of papers overlapped is abutted against a side face of the opening/closing bar at the hole side and the holes of the papers and the ring pieces are corresponded each other, then the opening/closing bar is pulled out to cause the ring pieces to be fitted resiliently in the holes of the papers to finish binding.

Further, where the ring binder binding papers is to be removed to separate the papers and the ring binder, the papers are made to be located at the ring piece side of the ring binder, at that state, the opening/closing bar is made to be inserted in the ring binder.

In an invention described in a second aspect, in the first aspect, swollen portions are provided on both side ends of the opening/closing bar so as to be slid in the cur ring and base portion. According to the second aspect of the present invention, on both side ends of the opening/closing bar, swollen portions are provided respectively, and when the opening/closing bar is inserted inside the ring binder, a sliding of the opening/closing bar against the curl ring is made to be smooth. When the opening/closing bar opens the ring pieces, ends of a plurality of papers overlapped are abutted against a side wall of the opening/closing bar at the side of holes and the holes of the papers are made to correspond to the ring pieces of the curl ring, then the opening/closing bar is pulled out to cause the ring pieces of the curl ring to be fitted in the holes of the papers to finish binding.

Further, where the ring binder to bind papers is removed to separate the papers and the ring binder, the papers are made to be located at the ring piece side of the curl ring, in that state, the opening/closing bar having the swollen portions is inserted in the ring binder.

An invention described in a third aspect of the present invention, in the second aspect, a side wall face of the side having swollen potions of the opening/closing bar is formed linearly in section from an intersection between the lower swollen portion and the side wall face to the upper swollen portion along a tangential direction of the upper swollen portion in such a manner as the tips of the ring pieces are traced at a closing time.

According to the third aspect of the present invention, the side wall face at the swollen side of the opening/closing bar is configured linearly in section so as to coincide a tangential line of the upper swollen portion led from the intersection between the lower swollen portion and the side wall face to the upper swollen portion, and by abutting the ends of the papers overlapped in plurality at the hole side to this linearly spread wall face the papers are imbricated along the wall face and the imbricated holes of the papers and the moving traces of the tip ends of the ring pieces are coincided, thereby at the time of binding the insertion of the tip ends of the ring pieces in the holes becomes easier.

Further, where the papers and the ring binder are to be separated by removing the ring binder binding the papers, in the state where the papers are located at the ring piece side of the ring binder, the opening/closing bar is inserted in the ring binder.

In a fourth aspect of the present invention, in the first, second and third aspects, a guide plate is formed integrally with the opening/closing bar along the longitudinal direction, perpendicular to the side face, on which the swollen portions are provided, and near a back side of the opening/closing bar, wherein an upper surface of the guide plate is used as a stand for holding the papers to be bound and a lower surface of the guide plate is used as a guiding face when the opening/closing bar is inserted in the ring binder.

According to the fourth aspect of the present invention, the guide plate is provided integrally on the side face on which the swollen portions are provided along a longitudinal direction and perpendicular to the opening/closing bar. And when the ring pieces of curl ring are opened by inserting this opening/closing bar having the guide plate while the guide plate being in up-position of its upper surface and the lower surface of the guide plate sliding on the base portion of the ring binder. And, after opening the ring pieces the upper surface of the guide plate becomes a stand for putting the ends of the papers at the hole side, and by abutting the ends of the papers against the side face the papers are positioned. Then, by pulling out the opening/closing bar, the tip ends of the ring pieces are inserted in the holes of the papers in turn due to the resiliency.

Further, where the papers and the ring binder are to be separated by removing the ring binder binding the papers, in the state where the papers are located at the ring piece side of the ring binder, and make the guide plate positioned at the ring piece side of the curl ring and the opening/closing bar are made to be inserted in the curl rings of the ring binder and under the lower most papers in such a manner as it supports the papers.

According to a fifth aspect of the present invention, in the fourth aspect, the guide plate is extended perpendicular to the opening/closing bar so as to assure to hold the ends of the papers.

In a sixth aspect of the present invention, in the fourth or fifth aspect of the present invention, the side wall surface is formed sectional-linear in tangential direction from the intersection between the guide plate and the side face of the opening/closing bar to the upper swollen portion, and along which the tip ends of the ring pieces trace.

According to the sixth aspect of the present invention, since the side wall surface is formed sectional-linear in tangential direction from the intersection between the guide plate and the side face of the opening/closing bar to the upper swollen portion, and to the side wall face the papers overlapped in a plurality number are abutted, the ends and the holes of the papers are imbricated andalong that imbricated holes the tip ends of the ring pieces trace at the time of closing, which makes it easier to bind the papers.

Further, where the papers and the ring binder are to be separated by removing the ring binder binding the papers, in the state where the papers are located at the ring piece side of the ring binder, and make the guide plate positioned at the ring piece side of the curl ring and the opening/closing bar are made to be inserted in the curl rings of the ring binder and under the lower most papers in such a manner as it supports the papers.

In a seventh aspect of the present invention, guide portions are provided on both sides of a plane paper putting portion integrally, and on the front lower portion of the guide portion, a binder setting portion one part of which faces to the front lower portion of the paper putting portion is provided rotatably and on an upper portion of the guide portion a paper holding portion for holding the papers put on the putting portion is provided rotatably, which thereby constitute an auxiliary device for forming a binding apparatus in combination with the opening/closing bar to function as a means for opening the ring pieces of the curl ring set in the binder setting portion.

According to the seventh aspect of the present invention, the guide portions for guiding the papers put on the putting portion are provided integrally on both sides of the plane paper putting portion. Further, a binder setting portion is provided rotatably at the front lower portion of the guide portion, and where the papers are punched, the papers are positioned. Further, and at the front upper portion of the guide portion a paper holding portion to hold the papers is provided rotatably and the papers positioned at the putting portion are clamped with the putting portion and the holding portion to fix. And, the opening/closing bar is inserted in the curl ring of the ring binder set in the binder setting portion and open the curl ring, hereafter the opening/closing bar is pulled out to bind the papers.

Further, where using the auxiliary device and the opening/closing bar the papers and the ring binder are to be separated by removing the ring binder binding the papers, in the state where the papers and the ring pieces are located at the side of the putting portion of the auxiliary device, and the ring binder is made to be positioned at the binder setting portion, further making the guide plate positioned at the putting portion side, the opening/closing bar is made to be inserted in the curl ring while making in the lower most papers so as to support the papers.

In an eighth aspect of the present invention, in the seventh aspect, a groove portion is provided at the binder setting portion for setting ring binder along the front edge of the putting portion, and on one side wall of the groove a plurality of projections for being engaged with the curl ring of the ring binder are provided at intervals and the other side wall is formed lower than the one side wall and the upper end thereof is made to be a guide portion for the guide plate.

According to the eighth aspect of the present invention, a plurality of projections for positioning are provided at an interval on one side wall of the groove formed on the binder setting portion, the ring pieces of the ring binder are positioned by being engaged with these. Further, the other side wall is made lower than the one side wall, and in the case where the opening/closing bar is inserted in the curl ring set in the binder setting portion, it functions as a guide.

In a ninth aspect of the present invention, in the eighth aspect, intervals of the projections provided on the one side wall are formed at the entrance side of the opening/closing bar narrower than inside ones.

According to the ninth aspect of the present invention, the intervals of the positioning projections provided on one side wall of the groove are formed narrower at an area close to the entrance of the opening/closing bar, thereby it becomes easier to be entered by the opening/closing bar. After entering in the curl ring of the ring binder, due to a wide interval of the positioning projection, the opening/closing bar is held and becomes easier to slide.

In an tenth aspect of the present invention, a binding apparatus is formed with a groove to position the ring binder and a binder setting device formed by side walls one of which is made to be lower, and the opening/closing bar to be inserted so as to open the curl ring.

According to the tenth aspect of the present invention, the binder setting device is provided with the groove and the side wall portions one of which is formed lower than the other to form the groove, and by sliding on the side wall portion the guide plate of the opening/closing bar is guided and the ring binder is set and positioned at the groove portion. By inserting the opening/closing bar in the binder setting device set and positioned, the curl ring is opened and the papers are bound. Further, by setting the ring binder binding papers in the binder setting device and being inserted by the opening/closing bar, the ring binder and the papers are separated.

In an eleventh aspect of the present invention, the binder setting portion is provided perpendicular to an inclined putting member at the lower end portion to carry out the positioning of the papers put on the putting member. Further, on the binder setting portion a plurality of positioning projections are provided, with these projections the curl ring is engaged and thr ring binder is fixed, thereby the opening/closing bar is stabilized at the time of inserting and pulling out. Further, by setting the ring binder binding the papers is set in the binder setting device, and by inserting the opening/closing bar in the ring binder to separate the papers and the ring binder.

BRIEF DESCRIPTION OF THE PREFERRED EMBODIMENT

FIG. 9(*b*) is an enlarged view in section of a trace of ring pieces at the time of binding the papers, that is, at the time of closing the ring pieces.

EMBODIMENT

Figure 1:
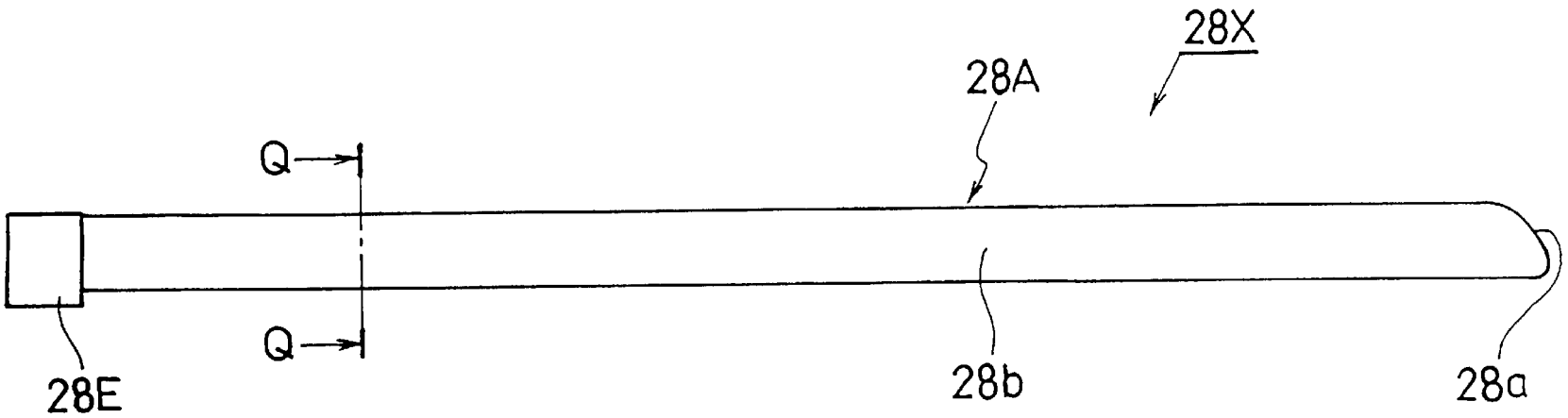
FIG. 1 is a front view of an embodiment of an opening/closing bar of the present invention.

Hereinafter, explanations of a ring opening/closing bar for a ring and a binding apparatus of the present invention will be done referring to attached drawings. FIGS. 1~19 relate to a ring opening/closing bar for opening curl rings 2 of a ring binder 3 for binding papers 1 and plastic covers, and FIGS. 20~40 relate to a binding apparatus formed in combination with the above opening/closing bar and an auxiliary device 21 for positioning the papers 1 and the plastic covers and the like. And further, FIGS. 41 and 42 relate to a binding apparatus formed in combination with the above ring opening/closing bar and a binder setting device 41 for positioning a ring binder 3.

Figure 2:
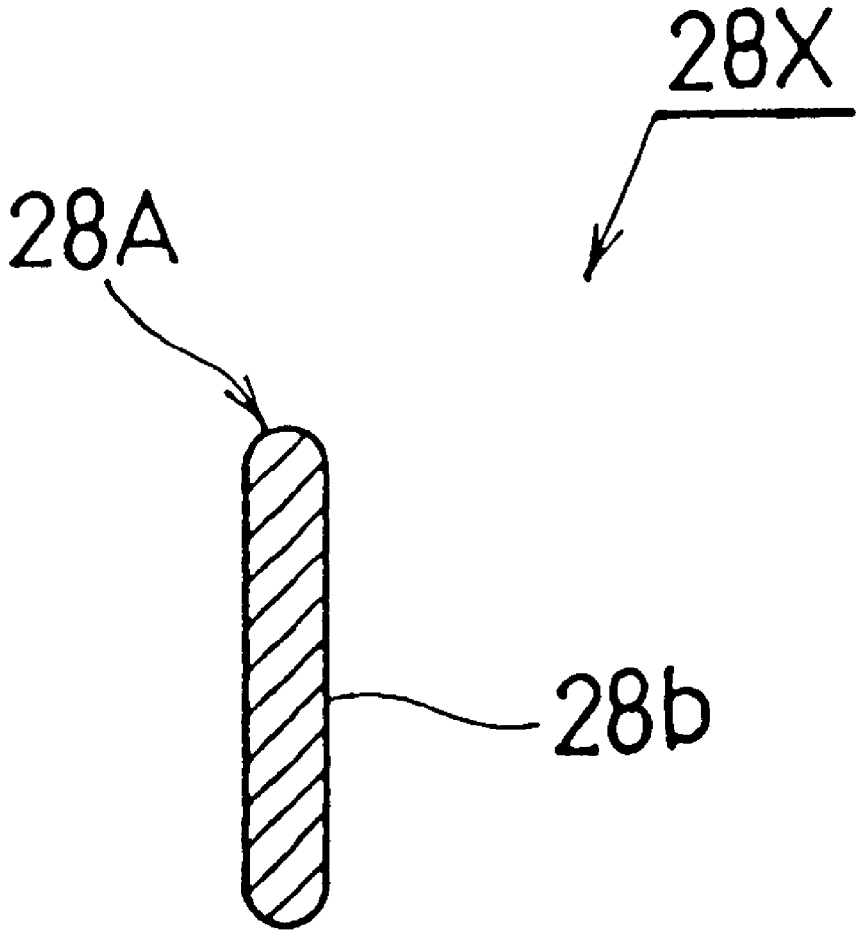
FIG. 2 is a sectional view along Q—Q line of FIG. 1.

First, a ring opening/closing bar 28X is explained shown in FIGS. 1 and 2. Identical signs with conventional arts are identically shown. This ring opening/closing bar 28X looks like approximately a sword in a front view and like I-letter in section as shown in FIG. 2, and a tip end of tip end of an opening/closing bar 28A is formed with an introduction part 28*a* so as to easily insert in a curl ring 2. The ring opening/closing bar 28X may be made of a resin or of a metal made, but in this embodiment a resin made one is used.

A shape of the introduction part 28*a* of the tip end of the opening/closing bar 28A is configured rounded. For reference, the shape of such introduction part 28*a* may be of any shape if it is configured like easily to be inserted in the curl ring 2, for instance, triangular, arch-like or oval. The portion of the opening/closing bar 28A except the introduction portion 28*a* has a width in dimension larger than the diameter of the curl ring to be inserted by the opening/closing bar so as to widen the ring pieces. In FIG. 1, a sign 28E shows a handle provided on a rear end of the opening/closing bar 28A.

Figure 3:
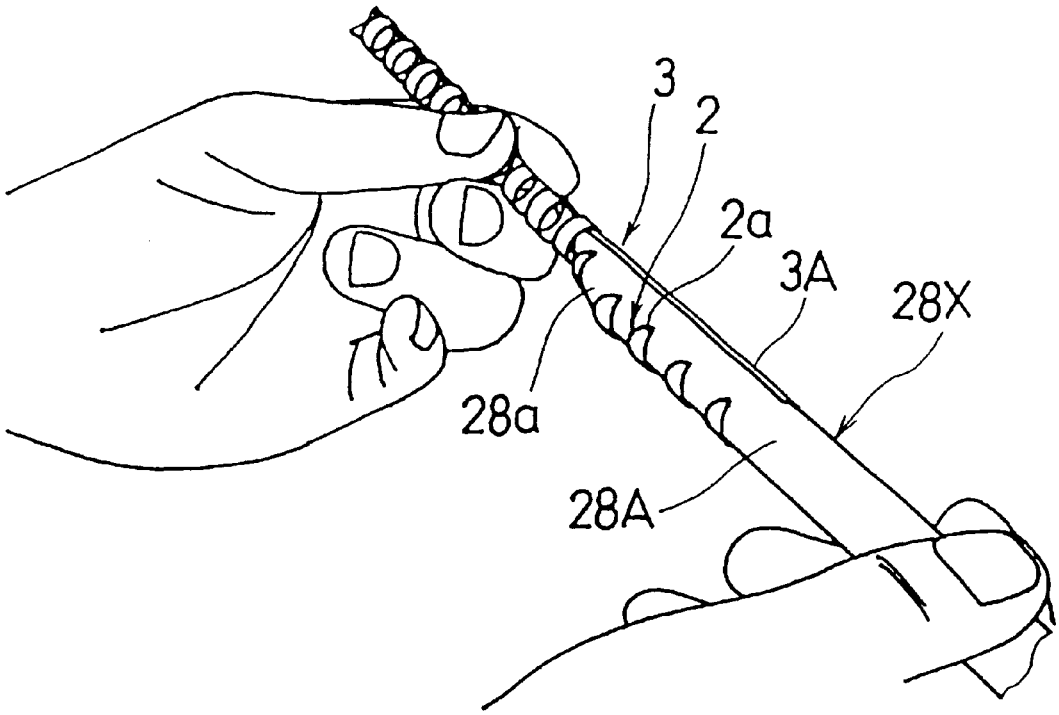
FIG. 3 is a perspective view of the opening/closing bar to open a ring binder.
Figure 4:
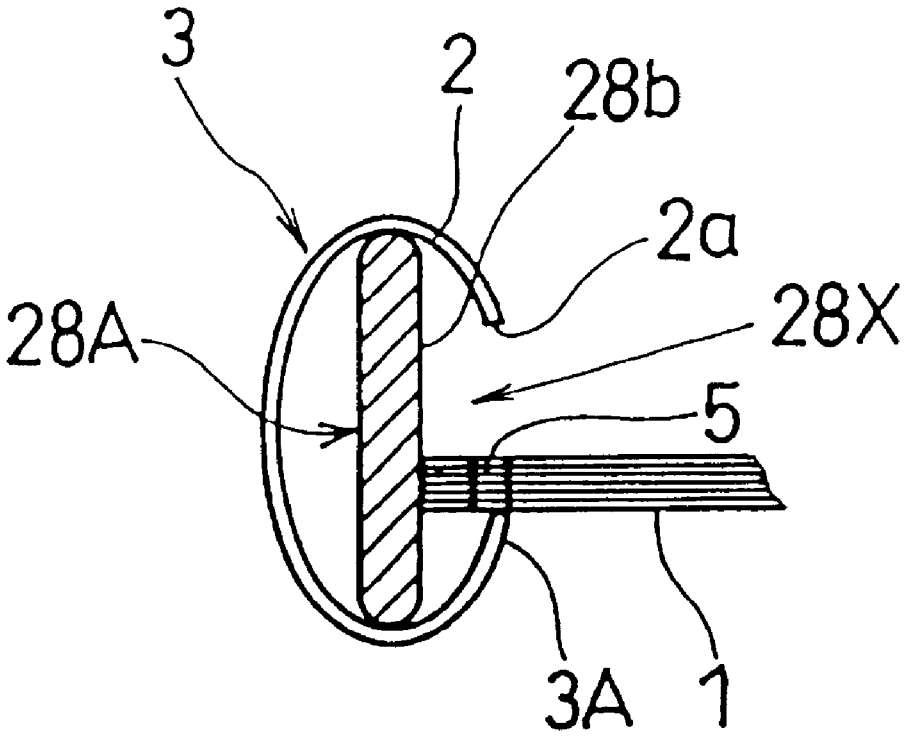
FIG. 4 is a partially sectional view when binding papers with the ring binder opened by the opening/closing bar.

A function of the opening/closing bar 28X is explained referring to FIGS. 3 and 4. Where the curl ring 2 of the ring binder 3 is to be opened, as shown in FIG. 3, while supporting the ring binder 3 with one hand, the ring opening/closing bar 28X is held with other hand, then a tip part (introduction part 28*a*) of the ring opening/closing bar 28X is forwarded in the curl ring 2 from an end of a base part 3A, thereby ring pieces 2*a* of the curl ring 2 of the ring binder 3 are in turn opened by being raised smooth with its introduction part 28*a*. In other words, when the ring opening/closing bar 28X is inserted, the ring pieces 2*a* of the curl ring 2 are separated from the base part 3A of the ring binder 3 and supported on one side end of the opening/closing bar 28A.

When the curl ring 2 is opened by the ring opening/closing bar 28X, ends of a plurality pieces of the papers 1 of the pierced hole 5 side are abutted to a side wall face 28*b* of the ring opening/closing bar 28A while being supported by the base part 3A and the holes 5 of the papers 1 and the ring pieces 2*a* are positioned by opposing each other. Then, the ring opening/closing bar 28A is pulled out from the ring binder 3, the ring pieces 2*a* of the curl ring 2 are fitted in the holes 5 of the papers 1 to bind the papers 1.

Further, in order to separate the papers 1 from the ring binder 3, the papers 1 are positioned where the papers are inserted by the ring pieces 2*a*, and the ring opening/closing bar 28A is inserted in the ring binder 3.

Figure 5:
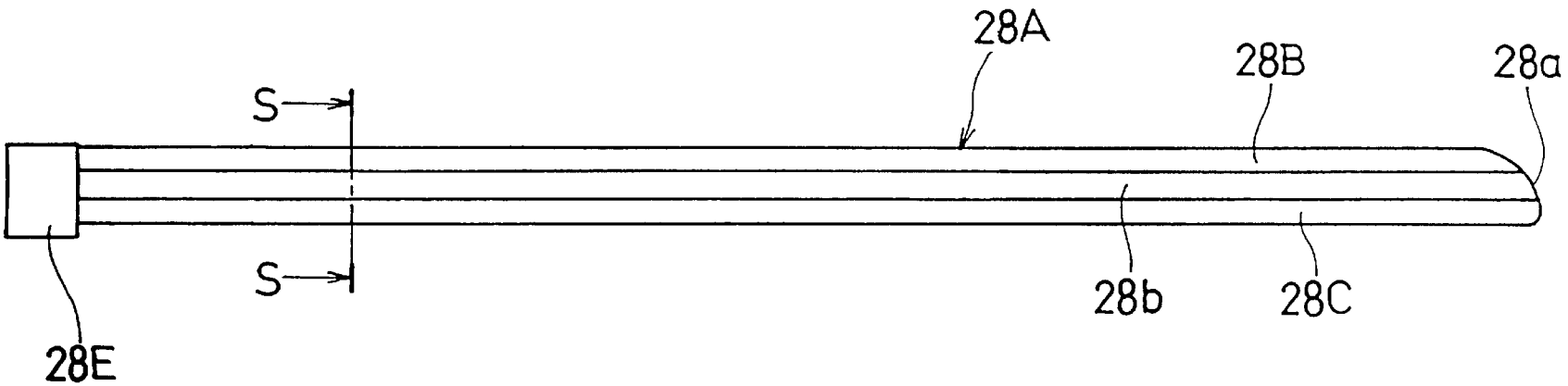
FIG. 5 is a front view showing another embodiment of the opening/closing bar of the present invention.
Figure 6:
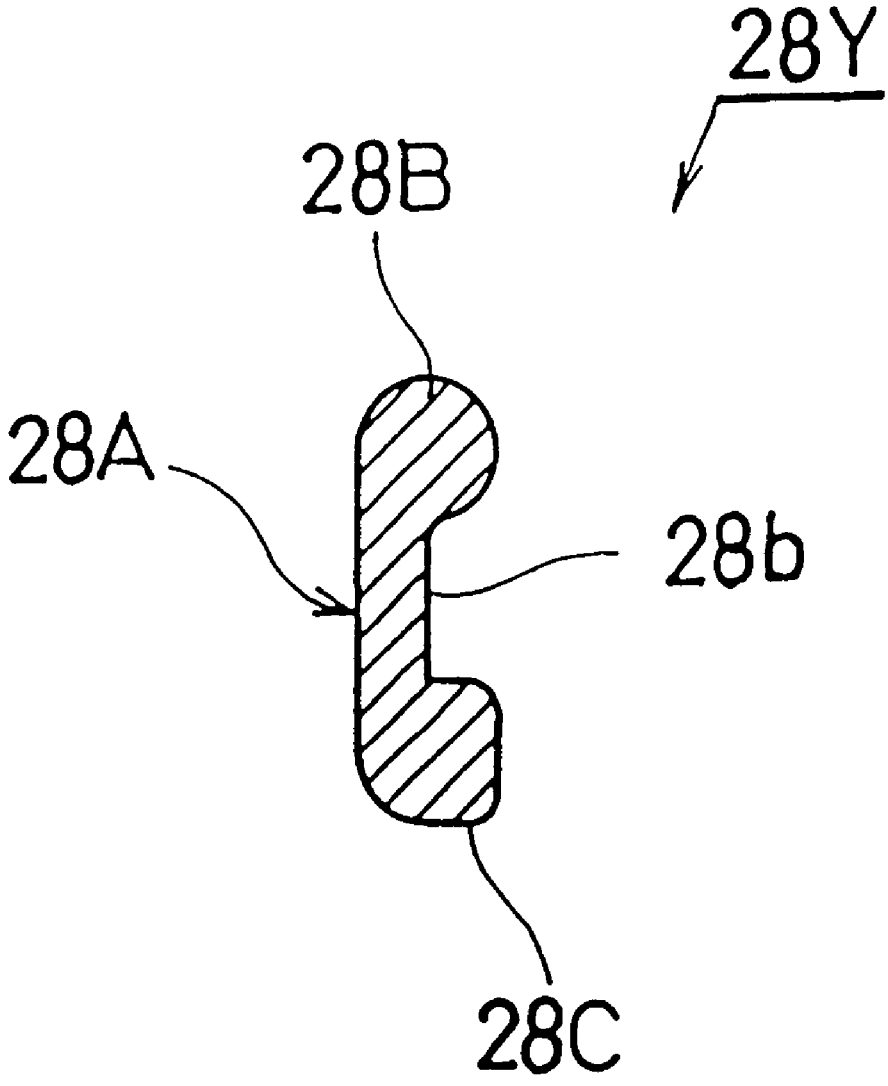
FIG. 6 is a sectional view showing along S—S line of FIG. 5.

Next, another embodiment of the ring opening/closing bar 28A is explained referring to FIGS. 5 and 6. For reference, the identical parts with the ones of FIGS. 1~4 are identically indicated and the explanations thereof are omitted. This ring opening/closing bar 28A is provided with the introduction part 28*a* on the tip end thereof. And, on both side ends of the plate-like opening/closing bar 28A along the longitudinal direction are provided with swollen portions 28B and 28C in section along overall length of the bar. These swollen portions 28B and 28C are disposed on one side of the plate-like bar 28A and when a short side of the bar is set vertically, the swollen portion 28B is located at an upper side and the swollen portion 28C is located at a lower side as shown in FIG. 6. Due to these swollen portions 28B and 28C, the papers 1 are easily supported between them.

The swollen portion 28B is configured approximately circular in section and the swollen portion 28C is configured approximately square in order to make the sliding friction small between the opening/closing bar 28A and the curl ring 2 when the bar is inserted.

Figure 7:
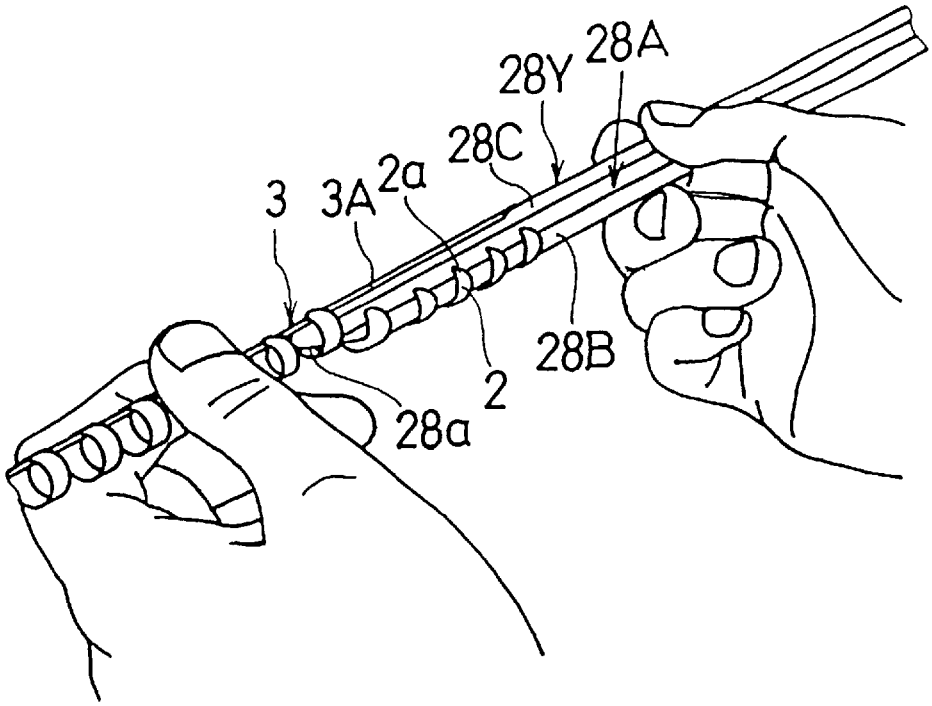
FIG. 7 is a perspective view showing a case where the ring binder is opened by the opening/closing bar shown in FIG. 5.
Figure 8:
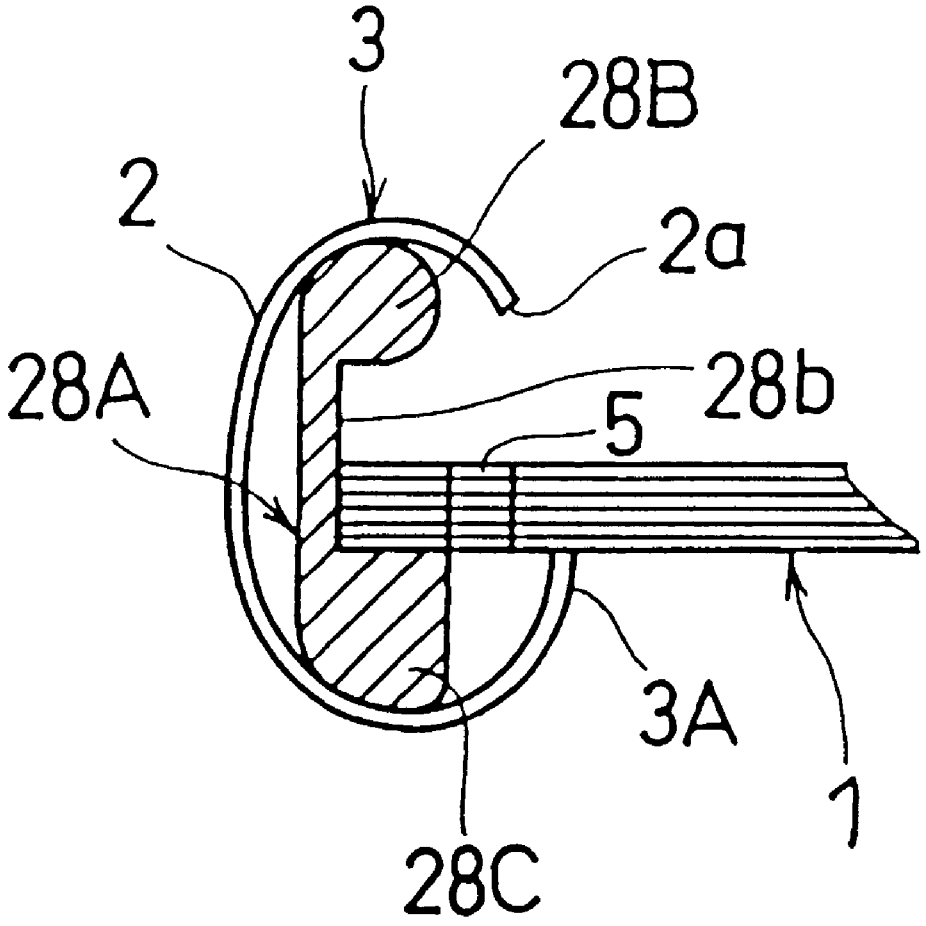
FIG. 8 is a partially sectional view showing that the papers are bound by the ring binder opened by the opening/closing bar in FIG. 5.

An operation of the above structured opening/closing bar 28A is explained referring to FIGS. 7 and 8. As shown in FIG. 7, the ring binder 3 is held by one hand, and the opening/closing bar 28A is held by the other hand, then the introduction portion 28*a* of the tip end of the opening/closing bar 28A is inserted into the curl ring 2 of the ring binder 3 from the end of thereof and due to the swollen portions 28B and 28C the opening/closing bar 28A is slid in the curl ring 2 smoothly.

After opening of the curl ring 2, a plurality of overlapped papers 1 are abutted to the side wall face 28*b* at the end side of hole to position the papers 1 to be bound, supported by the lower swollen portion 28C and the base portion 3A of the ring binder 3 and made the holes 5 of the papers 1 to correspond to the ring pieces 2*a* of the curl ring 2, then the opening/closing bar 28A is pulled out from the ring binder 3, thereby the ring pieces 2*a* of the curl ring 2 are in turn fitted in the holes 5 of the papers 1 to bind the papers 1.

Further, in order to remove the ring binder 3 and separate the papers 1 and the ring binder 3, the papers 1 are positioned in a state where the holes 5 are inserted by the ring pieces 2*a*, and the opening/closing bar 28A is inserted in the ring binder 3.

Figure 9A:
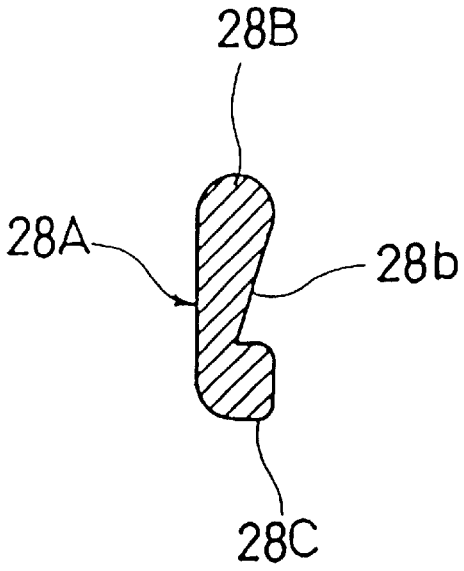
FIG. 9(*a*) is a view corresponding to FIG. 6 showing a sectional view of the side wall face of the opening/closing bar to be distortioned linear.
Figure 9B:
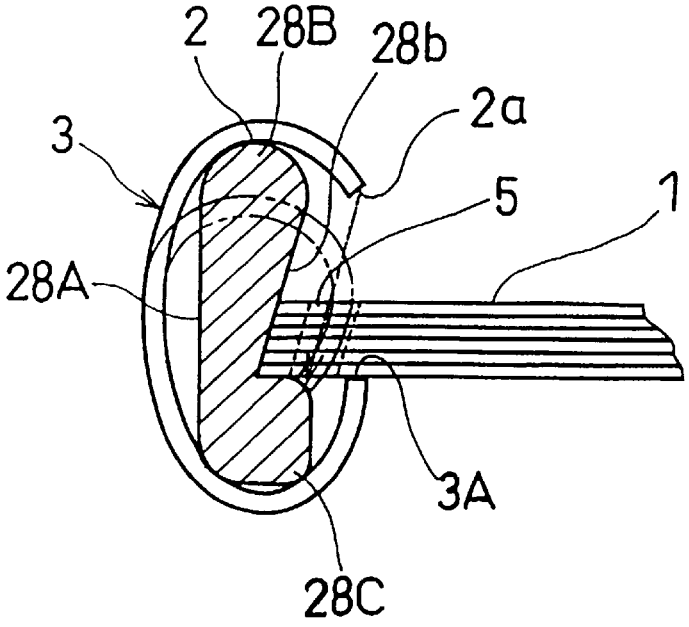
Figure 10:
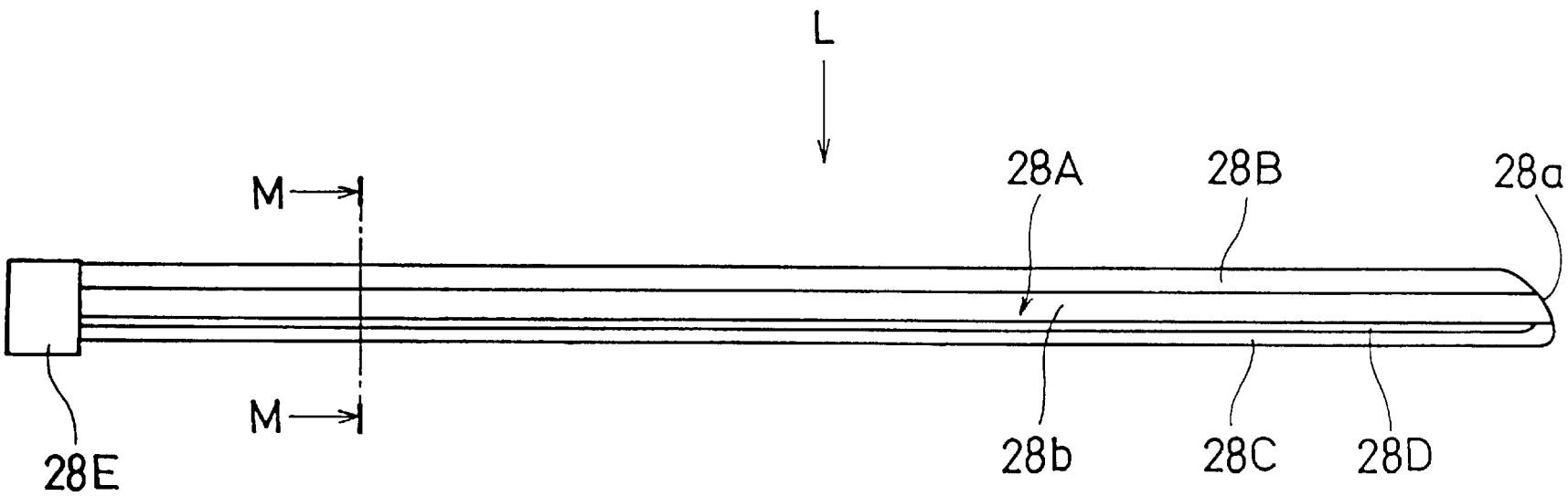
FIG. 10 is a front view of a further embodiment of the opening/closing bar of still further embodiment.

In an embodiment shown in FIG. 9(A), the side wall face on which the swollen portions 28B, 28C are formed with a face 28*b* containing a tangential linear in section which is extended from the upper swollen portion 28B to a proximal portion of the lower swollen portion 28C.

Thus, since the side wall face 28 on which the swollen portions 28B, 28C are provided is made to be an inclined plane face 28*b*, when a plurality of overlapped papers 1 abut against plane face 28*b*, the ends of the papers 1 are imbrignated along the inclined plane face 28*b*, as well the imbrignated holes 5 approximately coincide with a moving trace of the ring pieces 2*a* of the curl ring 2 at the time of closing due to resiliency.

Thereby, when filing the papers 1, the curl ring 2 becomes easily to fit in the holes 5 of the papers 1. This is because, when the curl ring 2 opens and closes, the ring 2*a* of the curl ring 2 moves approximately linearly with respect to the base portion 3A, so that if the ends of the papers 1 (the holes 5) are imbrignated linearly along the plane face 28*b*, the curl ring 2 is easily fitted in the holes 5 of the papers 1.

Further, in order to remove the ring binder 3 which is binding the papers 1 and separate the papers 1 and the ring binder 3, while positioning the papers 1 to be inserted by the ring pieces 2*a*, the opening/closing bar 28A is inserted in the ring binder 3. This opening/closing bar 28A is appropriate when removing a plurality of papers 1 overlapped.

Finally, another embodiment of the opening/closing bar 28A shown in FIGS. 10~14 is explained. For reference, signs of parts identical with what are shown in FIGS. 5~9 are attached with identical signs and explanations thereof are omitted. This opening/closing bar 28A is provided with a guide plate 28D on the side wall face (plane face) 28*b* and between the swollen portions 28B and 28C, in more detail, at the inner proximal portion of the swollen portion C integrally and perpendicular to the side wall face 28*b*. This guide plate 28D is provided on allover the length of the opening/closing bar 28 (see FIGS. 10 and 11).

And, one upper side of the guide plate 28D functions as a stand for the papers 1 and the lower side of the guide plate functions as a guiding portion to the base portion 3A of the ring binder 3 when the opening/closing bar 28A slides in the ring binder 3.

Figure 15:
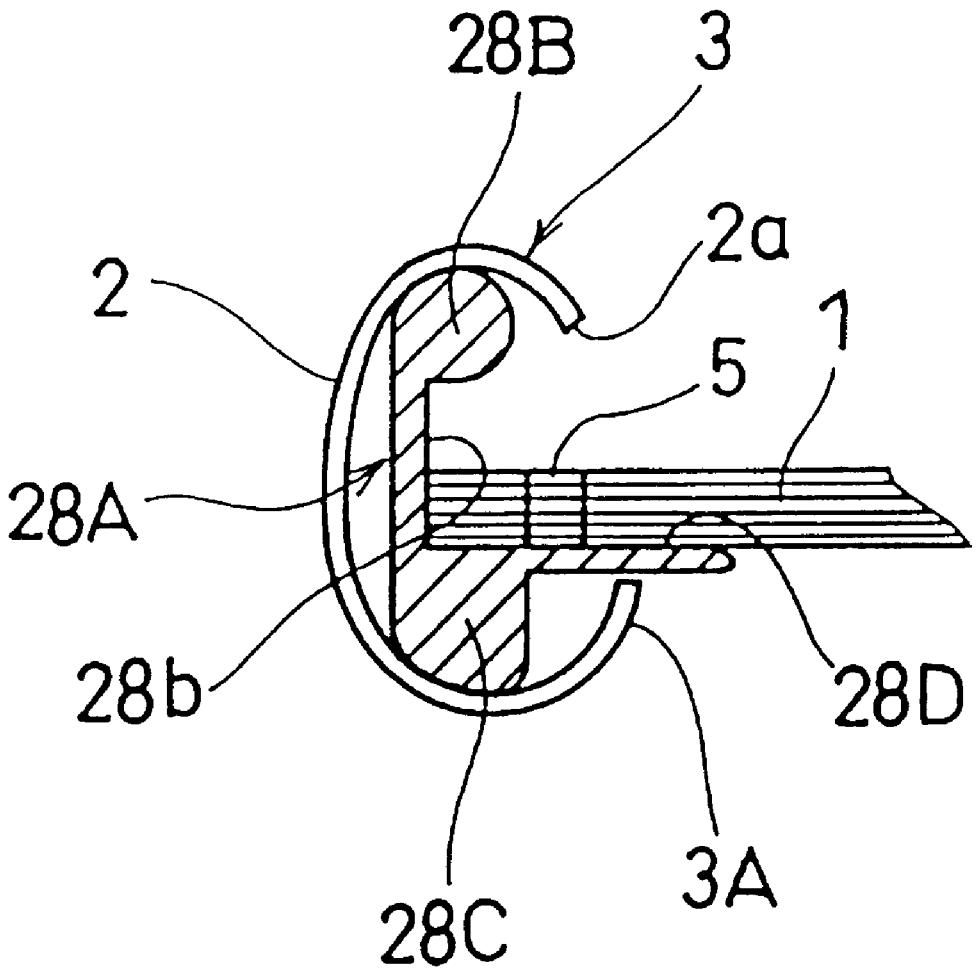
FIG. 15 is a partially sectional view showing that the papers are bound with the ring binder opened by the opening/closing bar shown in FIG. 10.

An opening manner of the curl ring 2 of the ring binder 3 using thus constituted opening/closing bar 28A is explained with FIG. 15. When the opening/closing bar 28A is inserted in the ring binder 3 while positioning the swollen portion 28B of the opening/closing bar 28A at the ring 2*a* side of the curl ring 2 of the ring binder 3 and the guide plate 28D at the base portion 3A of the ring binder 3, the ring pieces 2*a* of the curl ring 2 are in turn raised by the introduction portion 28*a* of the tip end of the opening/closing bar 28A and held on the swollen portion 28B side, and eventually all ring pieces 2*a* are opened.

Hereinafter, the ends of the hole 5 side of the papers 1 are abutted against the wall side face 28*b* to support the papers 1 on the guide plate 28D so as to coincide the tip ends of the ring pieces 2*a* with the hole 5 positions. From that state, by pulling out the opening/closing bar 28A the ring pieces 2*a* of the curl ring 2 are fitted in the holes 5 of the papers 1 in turn to bind the papers 1.

Further, in order to remove the ring binder 3 which is binding the papers 1 and separate the papers 1 and the ring binder 3, while positioning the papers 1 to be inserted by the ring pieces 2*a* and the guide plate 28D at the inner side of the ring 2*a* and under the lowermost papers 1, the opening/closing bar 28A is inserted in the ring binder 3. This opening/closing bar 28A is appropriate when removing a plurality of papers 1 overlapped.

For reference, the above embodiment may be formed by providing the guide plate 28D to the opening/closing bar 28A merely having the introduction portion 28*a* without providing the swollen portions 28B and 28C. An operation of this case is identical with the one of FIG. 15, so that an explanation thereof is omitted.

Figure 11:
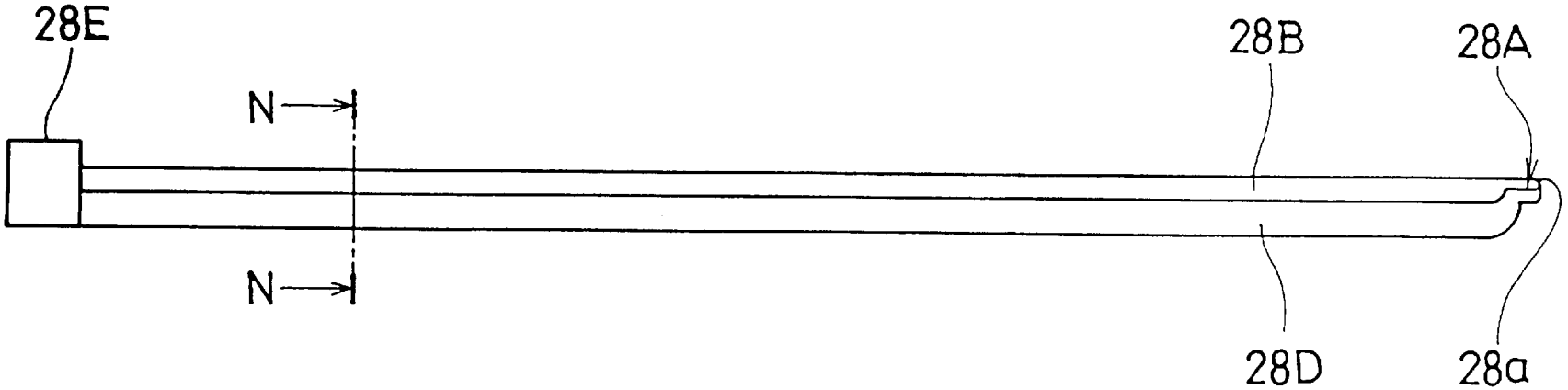
FIG. 11 is a view in arrow L of FIG. 10.
Figure 16:
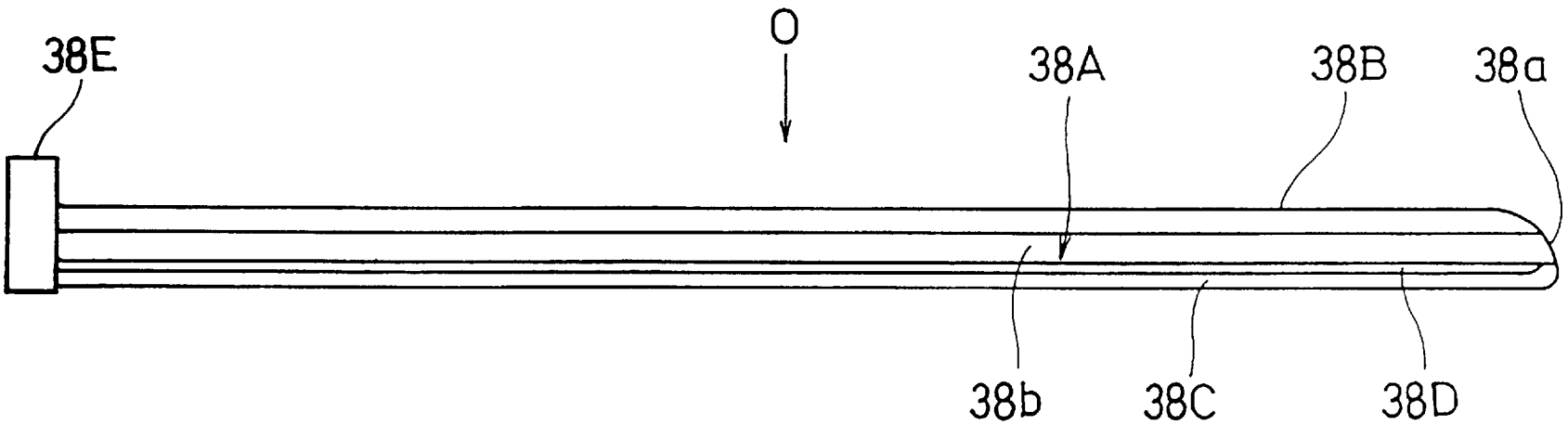
FIG. 16 is a front view showing another embodiment of FIG. 10.
Figure 17:
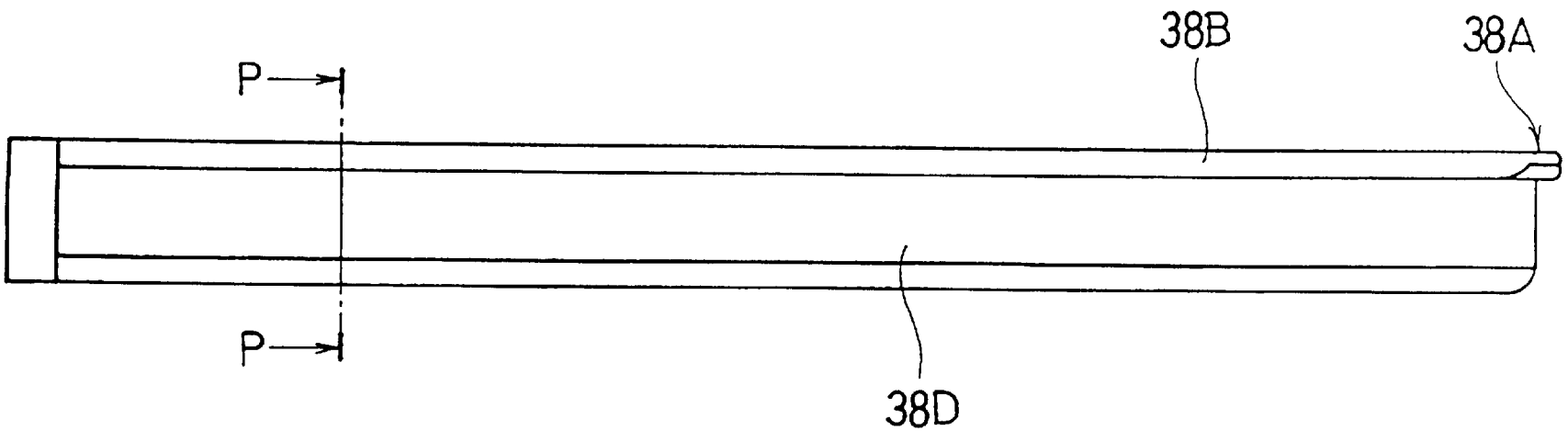
FIG. 17 is an arrow view of O of FIG. 16.
Figure 18:
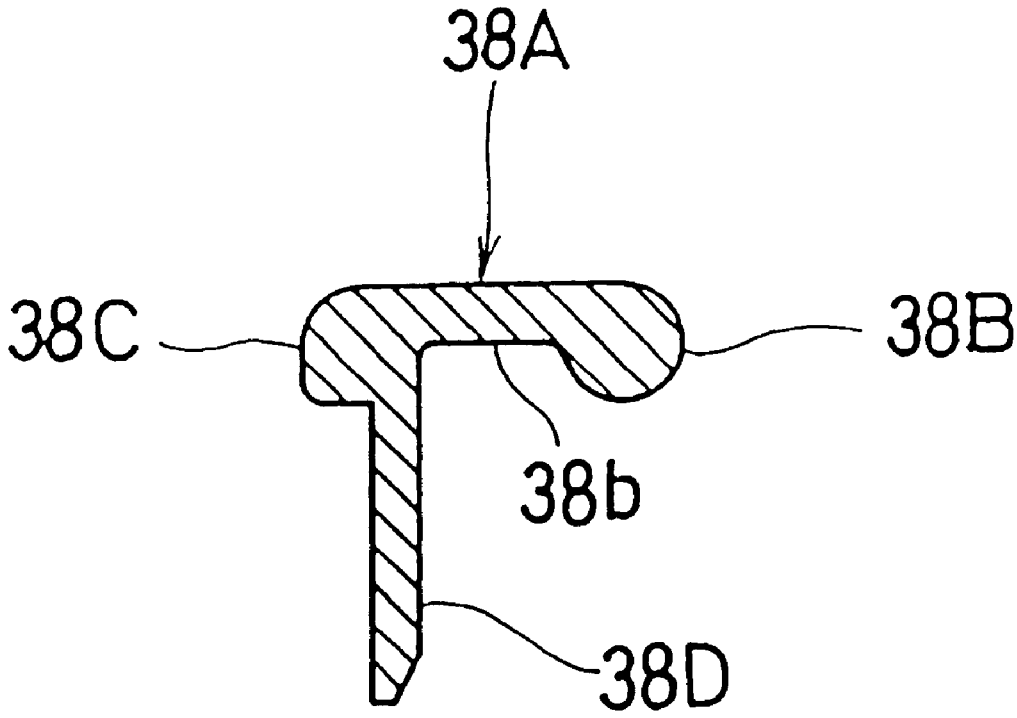
FIG. 18 is a sectional view along P—P of FIG. 17.

Further, an opening/closing bar 38A shown in FIGS. 16~18 shows another embodiment, in which the guide plate 38 D is formed on the side wall face 38*b* perpendicular thereto so as to be longer, as shown in FIG. 17, than the embodiment of the guide plate 28D shown in FIG. 11. As a result, the ends of the hole side of the papers 1 are stably held, thereby the ring pieces 2*a* of the curl ring 2 of the ring binder 3 becomes easily fitted in.

And, on the tip end of the opening/closing bar 38A also an introduction portion 38*a* as well as 28*a* in the previous embodiment, and on both side ends of the opening/closing bar 38A too, swollen portions 38B and 38C are formed. Further, the papers 1 can be abutted against the side wall face 38*a*. This opening/closing bar 38A operates as well as the opening/closing bar 28A, so that an explanation therefor is omitted.

Figure 12:
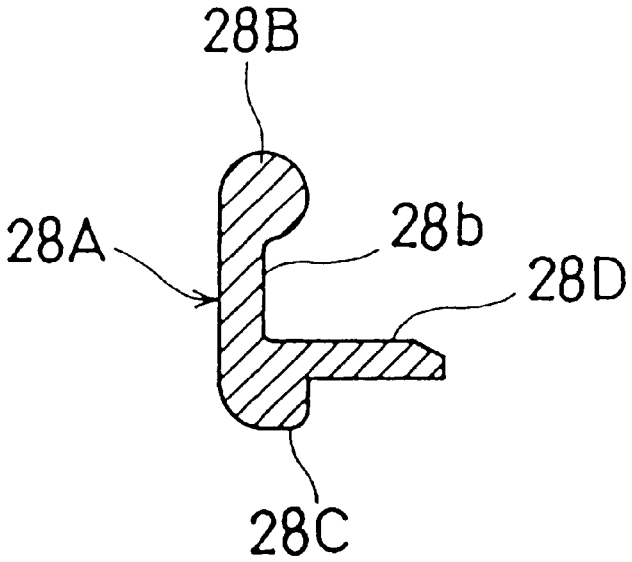
FIG. 12 is a sectional view along M—M line of FIG. 10.
Figure 13:
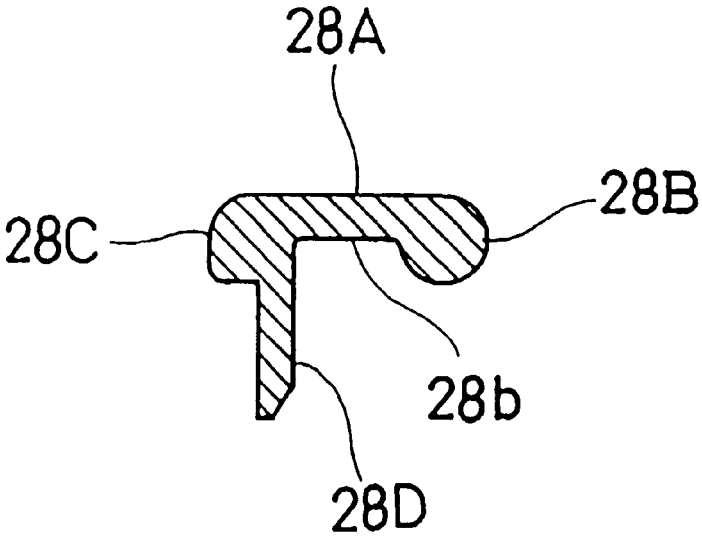
FIG. 13 is a sectional view along N—N of FIG. 11.
Figure 14:
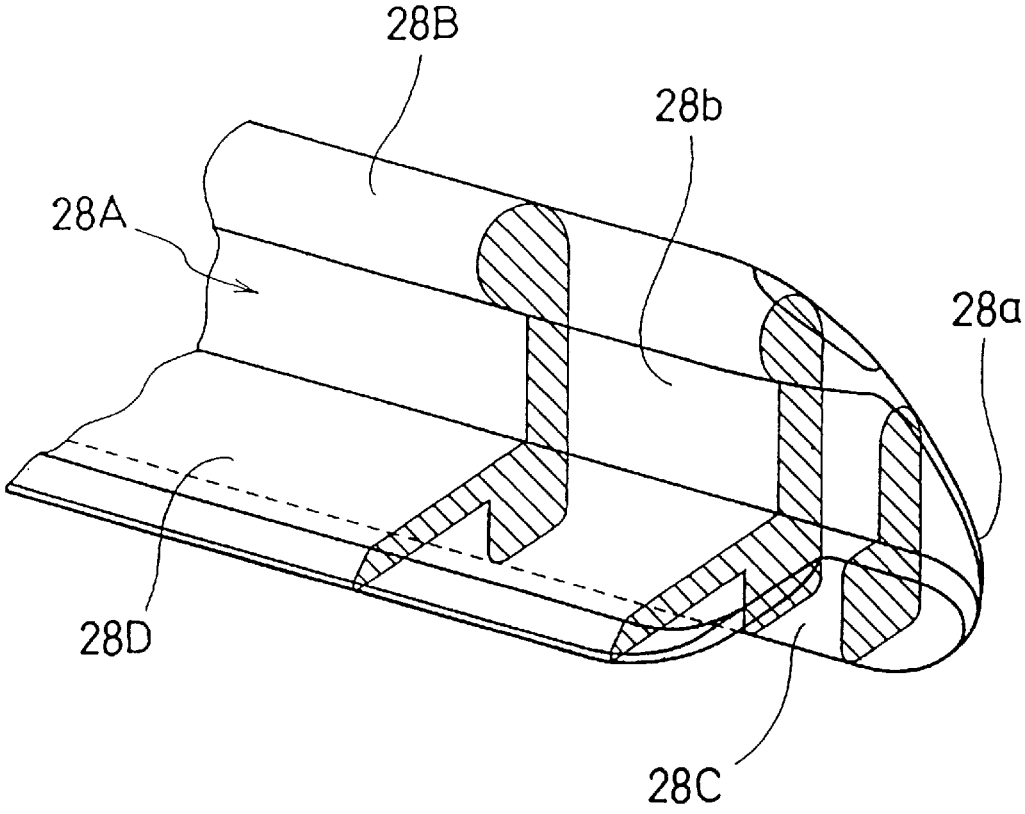
FIG. 14 is a perspective view of enlarged portion near the tip of the FIG. 10.

Now, if the opening/closing bars 28A and 38A are used in a laterally vertical posture and the height of the bars is more tall, the more lager in diameter curl rings 2 of the ring binder 3 can be opened, at that time the sectional shapes of the swollen portions 28B, 28C and 38B, 38C are made larger than what are shown in FIGS. 12 and 18. And, although the sectional shapes of the opening/closing bar 28A in the longitudinal direction are formed per embodiment an I-letter (plate-like), approximately C-letter and approximately L-letter, the shapes are not limited to those, the sectional shape of each opening/closing bar may be approximately circular, oval and polygonal (for instance a pentagon or hexagon).

Figure 19:
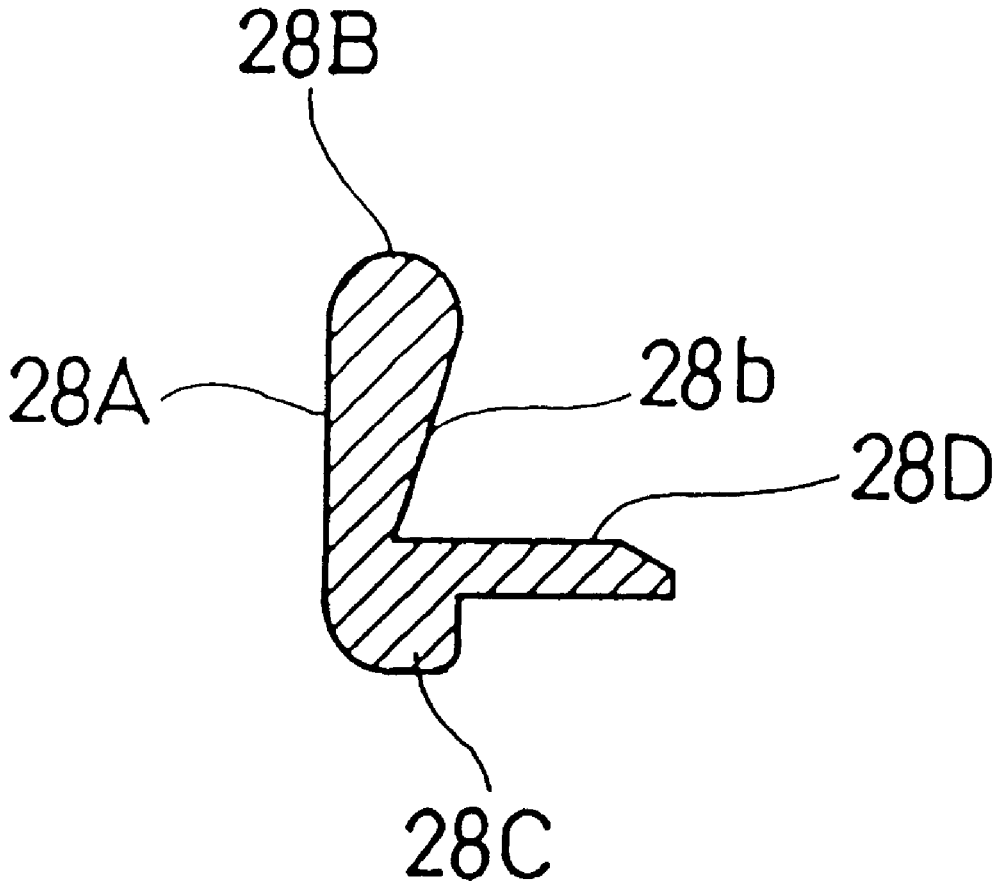
FIG. 19 is a sectional view of the side wall face distortioned linear of the opening/closing bar corresponding to FIG. 12.

Further, in the embodiment shown in FIG. 19, the side wall face 28*b* to which the guide plate 28D is formed is formed along a face containing every tangential line from the upper swollen portion 28B to the proximal portion of the guide plate 28, in such a manner as every tip ends of the ring pieces 2*a* of the curl ring 2 of the ring binder 3 traces the side wall face 28*b* at the time of closing. If a plurality of papers 1 are abutted against such a plane face at the hole 5 side, the ends of the hole side are imbricated, and thereby the holes 5 prepared for binding are also imbricated along the ends.

Accordingly, when binding a plurality of papers 1 with a ring binder 3, it is easily carried out by using the opening/closing bar. This is because, when the curl ring 2 is opened and closed, since the ring 2*a* of the curl ring 2 moves obliquely straight with respect to the base portion 3A, if the ends of the papers 1 at the side of the holes 5 are imbricated, the holes 5 of the papers 1 also disposed obliquely straight and the curl ring 2 is easily fitted in the holes 5 of the papers.

Figure 20:
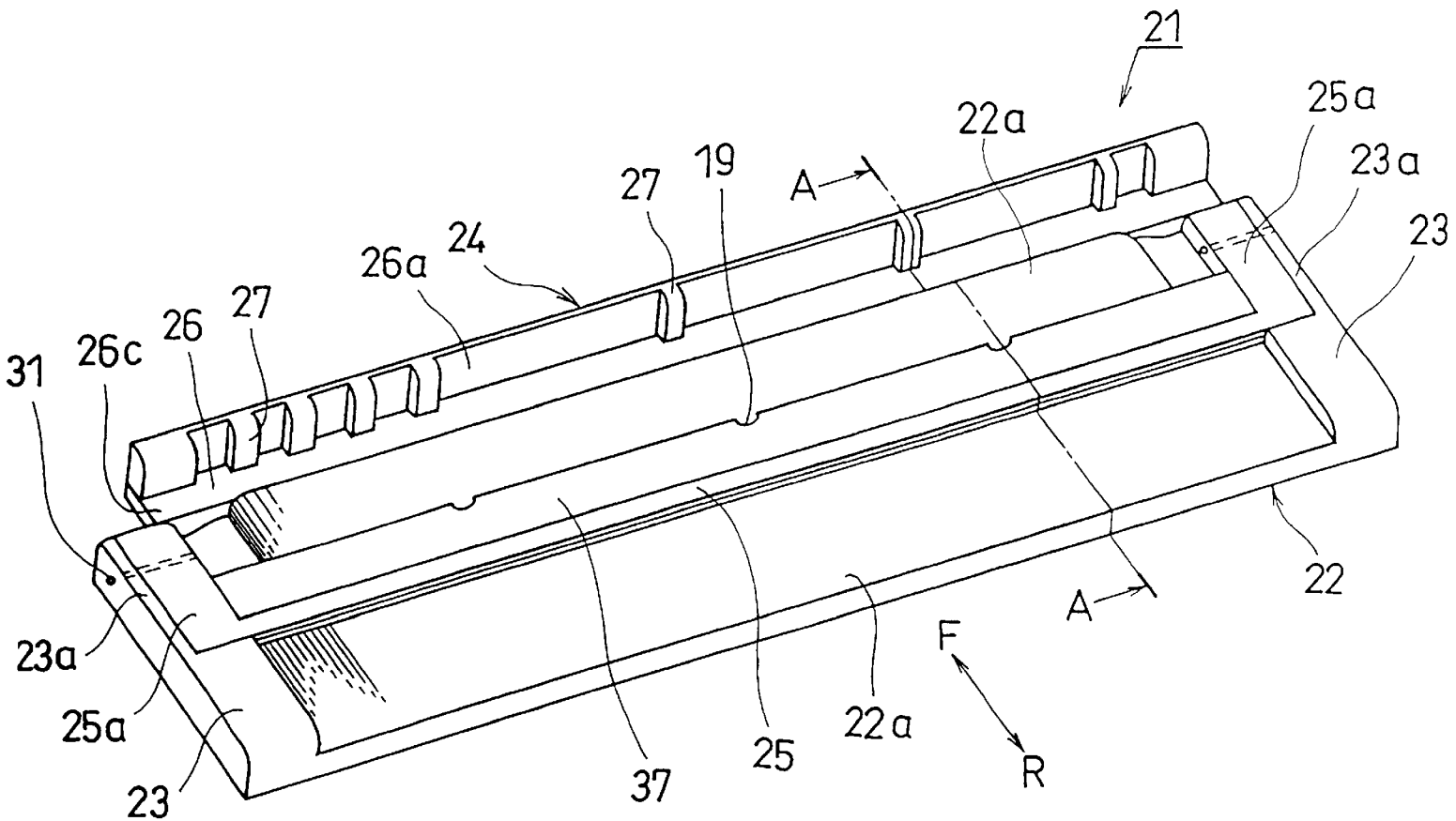
FIG. 20 shows a perspective view of an auxiliary device for enhancing the function of the opening/closing bar and constitute a binding apparatus with the opening/closing bar.
Figure 21:
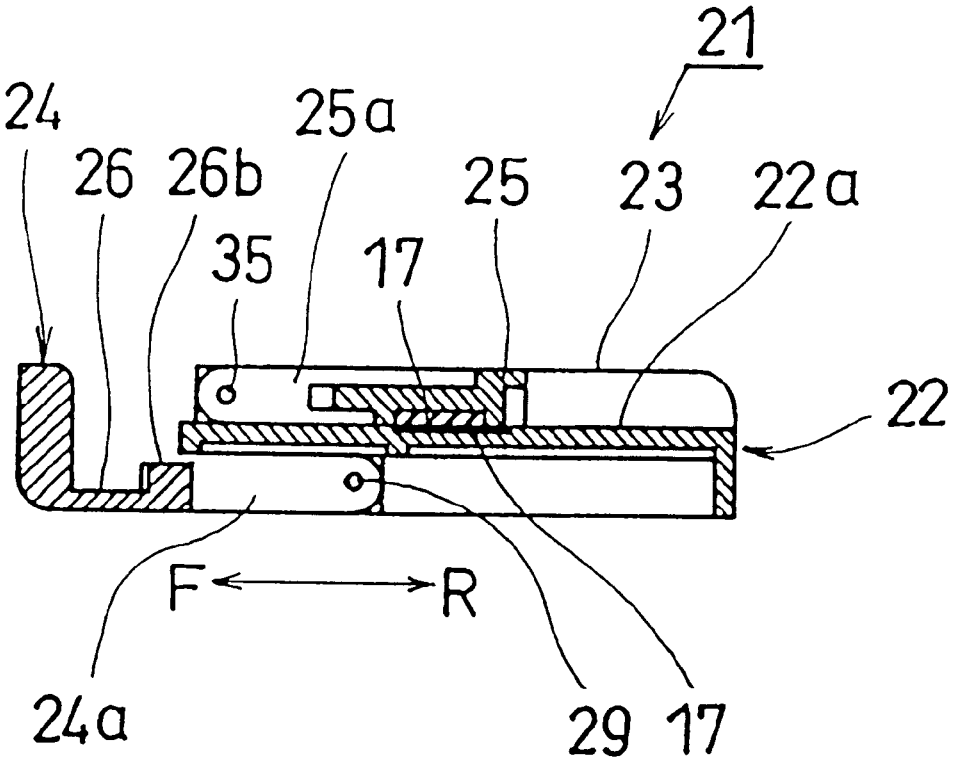
FIG. 21 is a sectional view along A—A line of FIG. 20.

Next, FIGS. 20 and 21 show an auxiliary device 21 for binding having functions of positioning the ring binder 3 and the like. A binding apparatus which is formed with a combination of this auxiliary device 21 for binding and the opening/closing bars 28A or 38A separated from the auxiliary device 21 will be explained. In this embodiment, it is illustrated that the ring binder 3 set in this auxiliary device 21 for binding is opened by the opening/closing bar 28A having the guide plate 28D (FIGS. 10~14). The auxiliary device 21 for binding functions to position the ring binder 3 to be opened so as to enable the opening/closing bar 28A to be easily inserted in the ring binder 3 at the time of opening the ring binder 3. Now, conventional members are attached identically with the identical signs. Further, in FIGS. 20 and 21, signs F and R show the front direction and rear direction of the auxiliary device 21 for convenience sake.

This auxiliary device 21 for binding is formed by adding a ring binder positioning means to a conventional punch for the papers 1. On both sides of a paper putting means 22 of the auxiliary device 21, guide portions 23 are formed integrally. Front sides of these guide portions are formed in a narrowed portion 23*a* respectively and on undersides of the narrowed portions 23*a* a ring binder setting portion 24 for positioning a ring binder 3 and papers 1 is mounted rotatably. On front upper sides of the narrowed portions 23*a* a holding portion 25 for holding the papers 1 put on a plane portion 22*a* of the paper putting means 22 is mounted rotatably.

Figure 22:
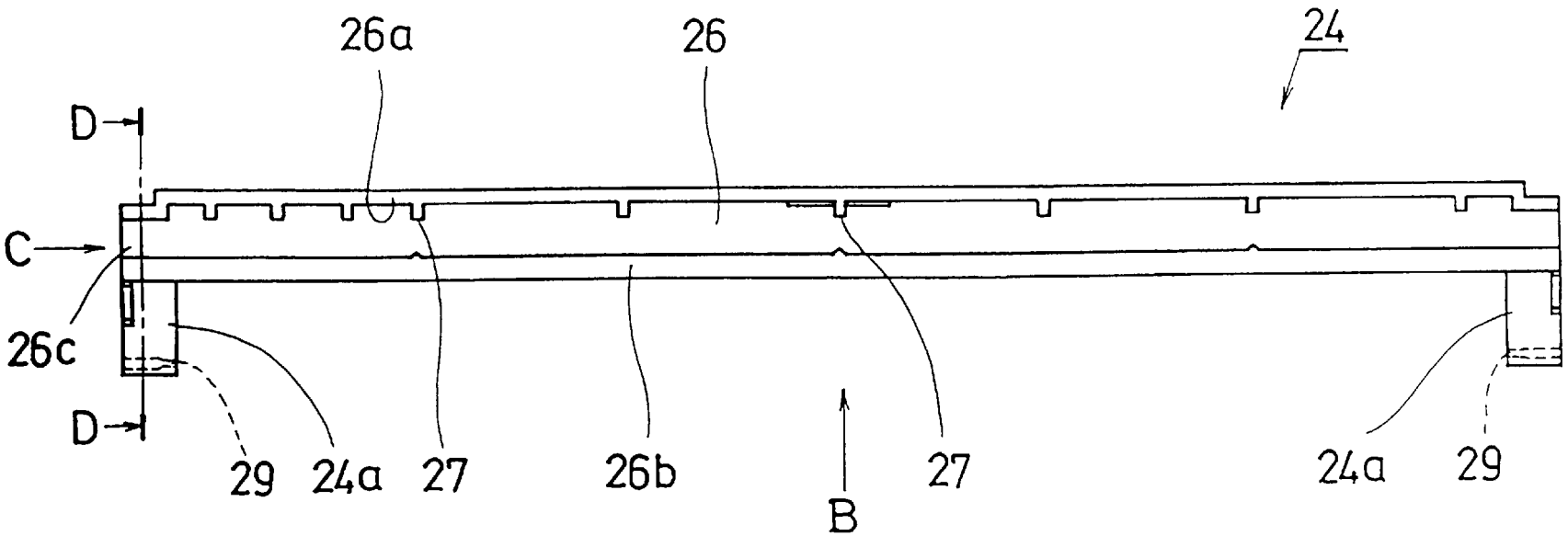
FIG. 22 is a plan view showing the binder setting portion shown in FIG. 20.
Figure 23:
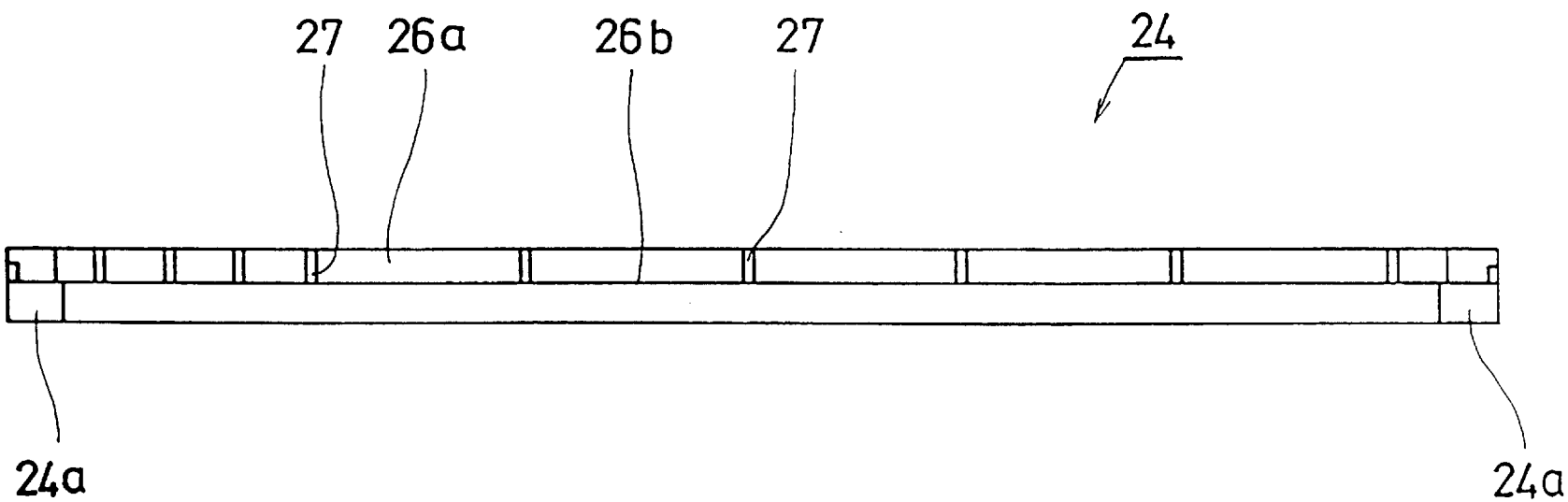
FIG. 23 is an arrow B of FIG. 22.
Figure 24:
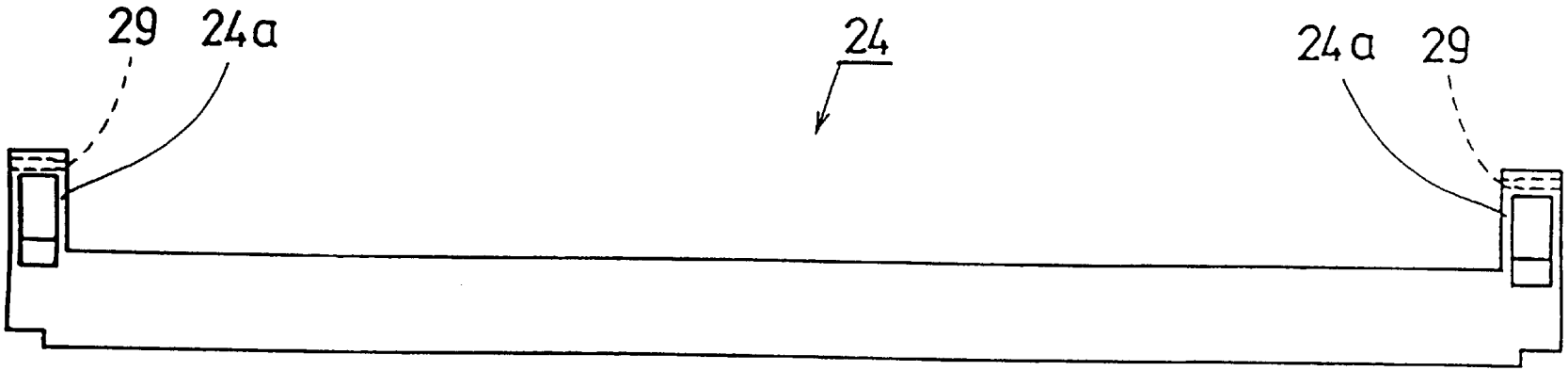
FIG. 24 is a bottom view of FIG. 22.
Figure 25:
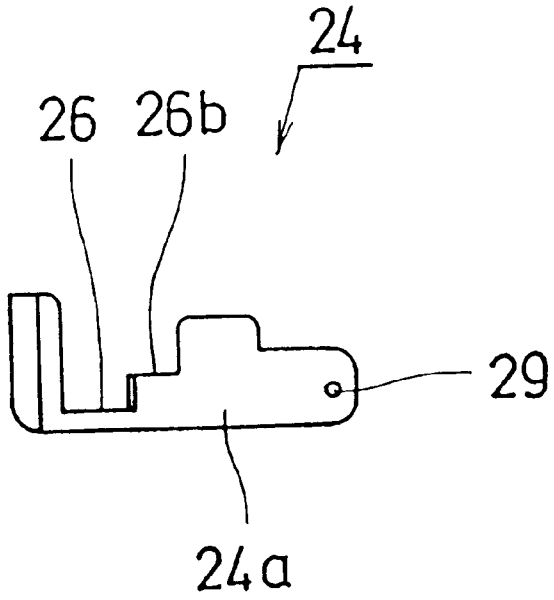
FIG. 25 is an arrow C of FIG. 22.
Figure 26:
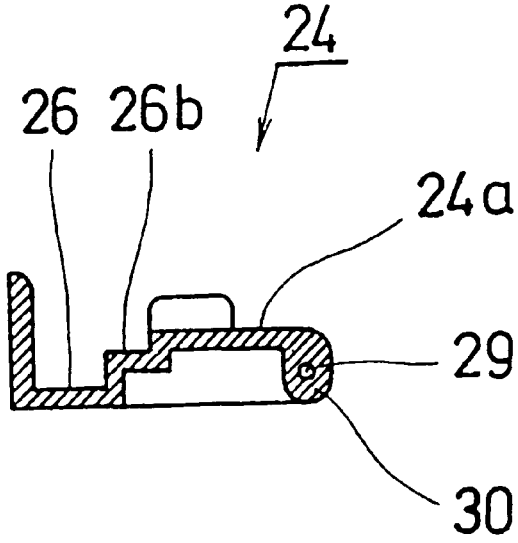
FIG. 26 is a sectional view along D—D of FIG. 22.

Hereinafter, respective portion is explained more in detail. FIG. 22 is a plan view of the U-letter shaped binder setting portion 24 mounted rotatably on the narrowed portions 23*a* of both sides of the paper putting member 22 and FIG. 23 is a front view (an arrow B in FIG. 22). Further, FIG. 24 is a bottom view thereof. A groove 26 is formed on the binder setting portion 24 along the front edge of the paper putting member 22 (see FIGS. 25 and 26). The ring binder 3 to bind the papers 1 is put in this groove 26. Accordingly, a width of the groove 26 is set approximately identical with the outer diameter of the ring binder 3.

Further, on one side wall 26*a* of the groove 26, a plurality of vertical projections 27 for positioning the curl rings of the ring binder 3 by being engaged with the curl ring 2 are provided at a given spacing. The spacing of the projections each other is arranged in such a manner as it becomes narrower most at an entrance portion 26*c* of the opening/closing bar 28A for being inserted fo opening the curl ring 2 set in the groove 26 and more wider at the portion passing over the entrance portion 26*c*. This arrangement is for the purpose of a smooth y inserting of the opening/closing bar in the ring binder 3.

Further, the another side wall 26*b* is formed lower than the one side wall 26*a* in height. That is, the height of the another wall 26*b* is arranged in such a manner as one area of the upper end of the another wall 25*b* is faced to the underside of the front edge of the paper putting member 22 when the binder setting portion 24 is mounted on the paper putting portion 22. And, bearing portions 30 (FIG. 26) having a bearing holes 29 are provided on both leg portions 24*a* of the binder setting portion 24.

Figure 27:
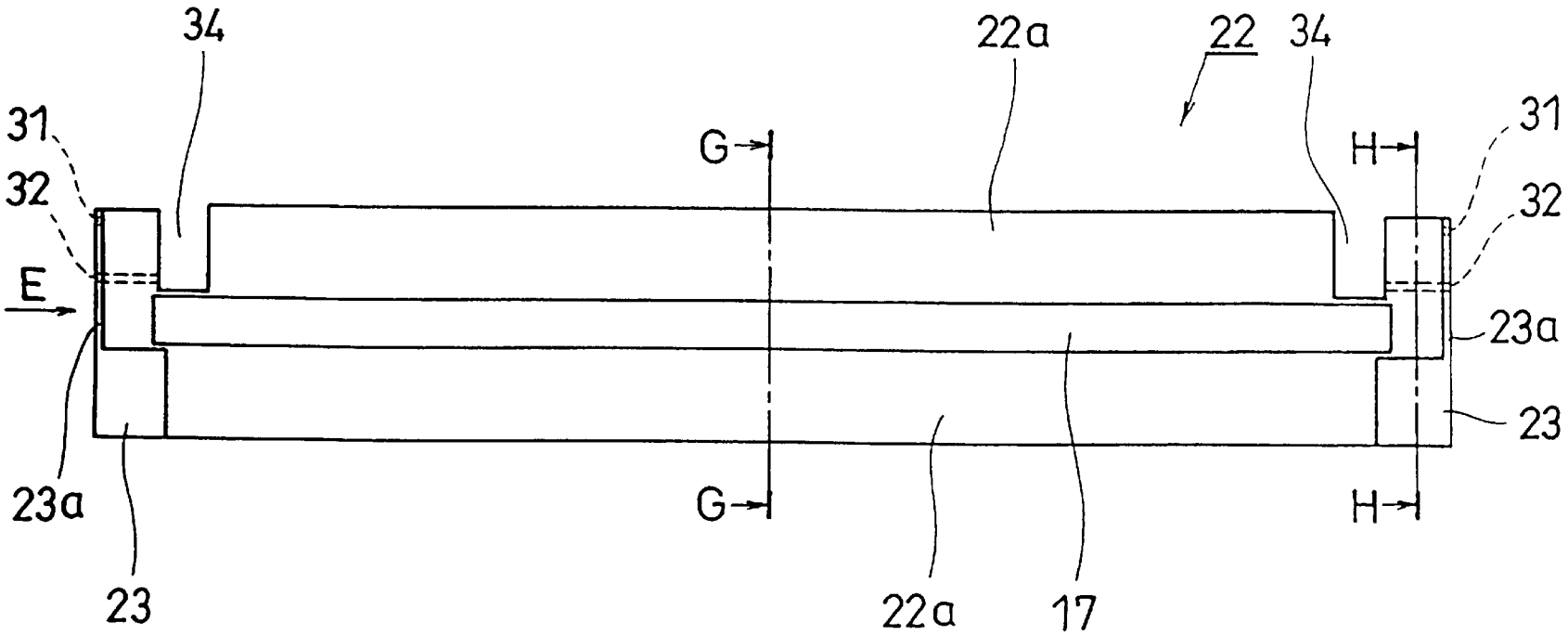
FIG. 27 is a plan of the putting member of FIG. 20.
Figure 28:
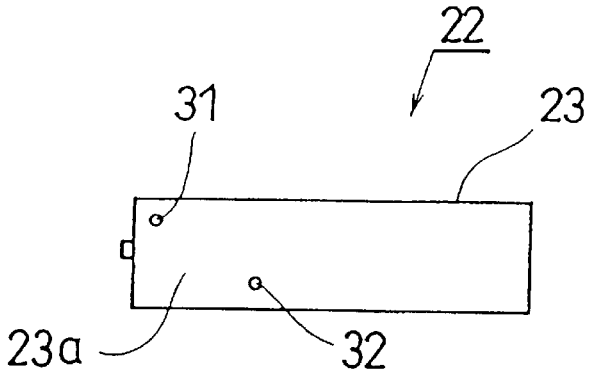
FIG. 28 is an arrow E of FIG. 27.
Figure 29:
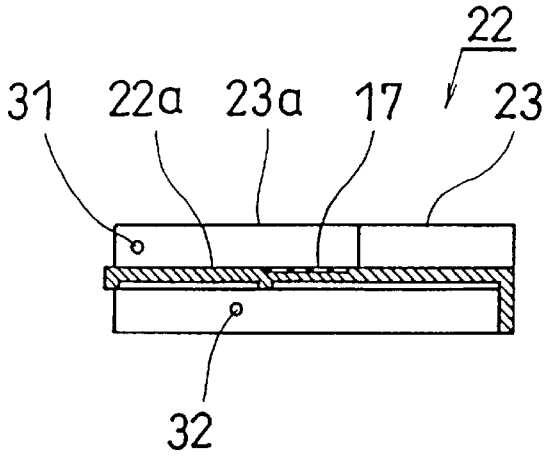
FIG. 29 is a sectional view along G—G line of FIG. 27.
Figure 30:
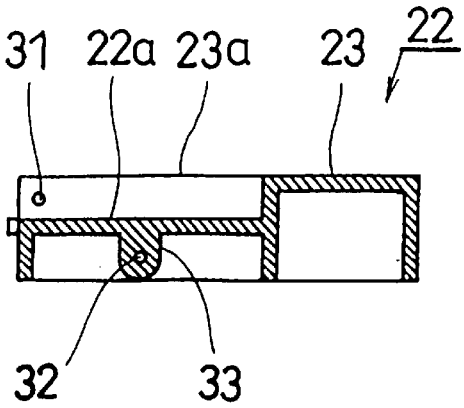
FIG. 30 is a sectional view along H—H line of FIG. 27.

FIG. 27 is a plan view of the paper putting portion 22. On both sides of the paper putting portion 22 wide guide portions 23 are provided integrally in a front-rear direction. The front side of the guide portion 23 is formed in a narrowed portion 23*a* integral with the guide portion 23. A bearing hole 31 is provided on the front-upper portion of the narrowed portion 23*a* (FIGS. 28~30), in which the holding portion 25 is mounted rotatably.

Further, a bearing portion 33 (FIG. 30) having a bearing hole 32 is provided at the underside of approximately intermediate portion of the narrowed portion 23*a* and the binder setting portion 24 is mounted rotatably through a not shown shaft which comes through the bearing hole 32 of the bearing portion 33 and a bearing hole 29 of the bearing portion 30 provided on leg portions 24*a* (FIG. 26) of the binder setting portion 24. These leg portions 24*a* of the binder setting portion 24 are mounted by being arranged in a cut out portion 34 of the plane portion 22*a* of the paper putting member 22. For reference, a sign 17 designates a magnet in FIGS. 21, 27 and 29, which is mounted on the plane portion 22*a*.

Figure 31:
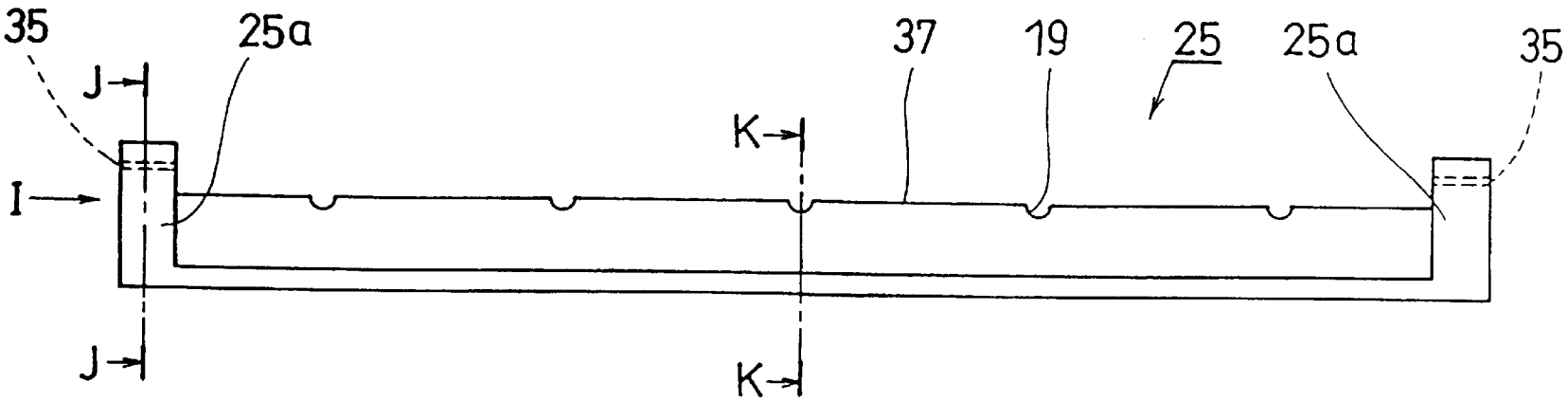
FIG. 31 is a plan view of the paper holding portion in FIG. 20.
Figure 32:
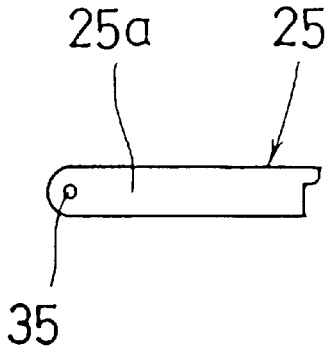
FIG. 32 is an arrow I of FIG. 31.
Figure 33:
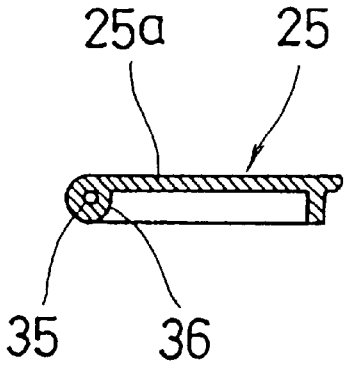
FIG. 33 is a sectional view along J—J line of FIG. 31.
Figure 34:
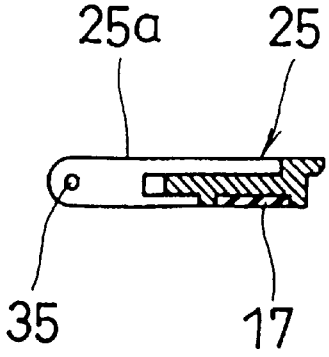
FIG. 34 is a sectional view along K—K line of FIG. 31.
Figure 35:
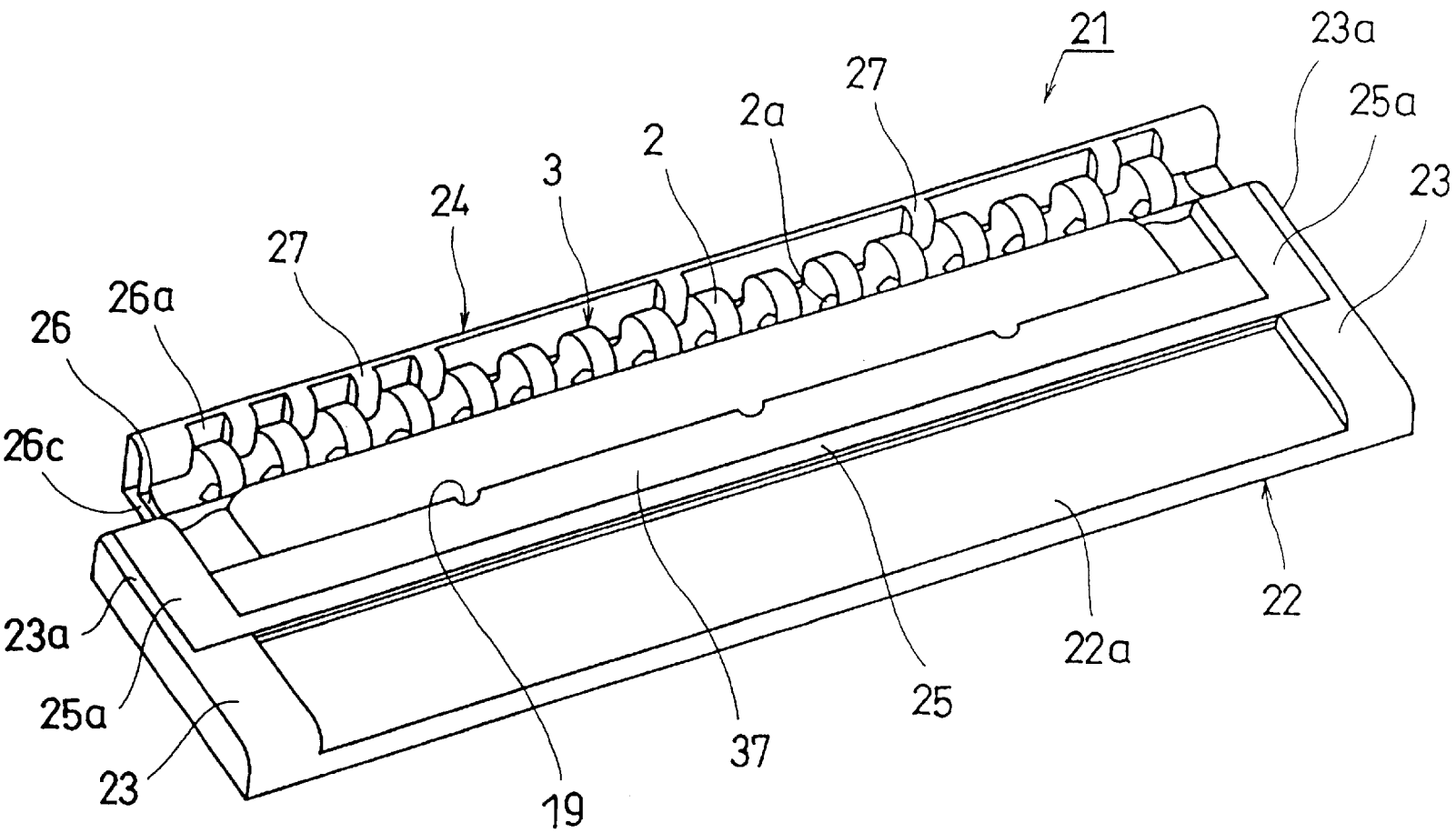
FIG. 35 is a perspective view showing that the ring binder is set in the binderr setting portion of the auxiliary device for binding.

FIG. 31 is a plan view of the above holding portion 25. The holding portion 25 is approximately U-letter shaped in a plan view and on each tip side of two leg portions 25*a* a bearing portion 36 having a bearing hole 35 is provided respectively (FIGS. 32~34). The binder setting portion24 is mounted rotatably on this bearing hole 35 and the bearing hole 31 (FIG. 28) of the narrowed portion 23*a* of the paper putting member 22.

Further, a punch guide plate 37 having recessed portions 19 for fitting a projection 19 to a punch 18 (FIG. 46) within an inside portion of the leg portion 25*a* in the holding portion 25. And, a magnet 17 is mounted on the surface of the paper holding portion 25 opposing the papers 1 so as to face to the magnet 17 of the plane portion 22*a* of the paper putting member 22 (FIG. 34).

The operation of the auxiliary binding device 21 for positioning the ring binder 3 is explained. This auxiliary device 21 is provided with two functions to punch the papers 1 and bind the papers 1 by opening the curl ring 2 of the ring binder 3. First, a function to punch the papers 1 is explained. Since this case is identical with the one punching operation explained in FIG. 46 as a conventional art, its explanation is simplified.

In FIG. 20, the holding portion 25 is raised so as to be separated from the putting member 22 of the auxiliary device 21 and in that status the papers 1 are put on the plane portion 22*a* of the putting member 22 and made the papers to come through the U-letter shaped holding portion and made the tip ends of the papers 1 to abut against the positioning projection 27 of the binder fitting portion 24 and thereafter, by laying down the holding portion 25 the papers 1 positioned are clamped by the holding portion 25 and the plane portion 22*a* of the putting member 22 and strongly held by the magnet 17.

Figure 46:
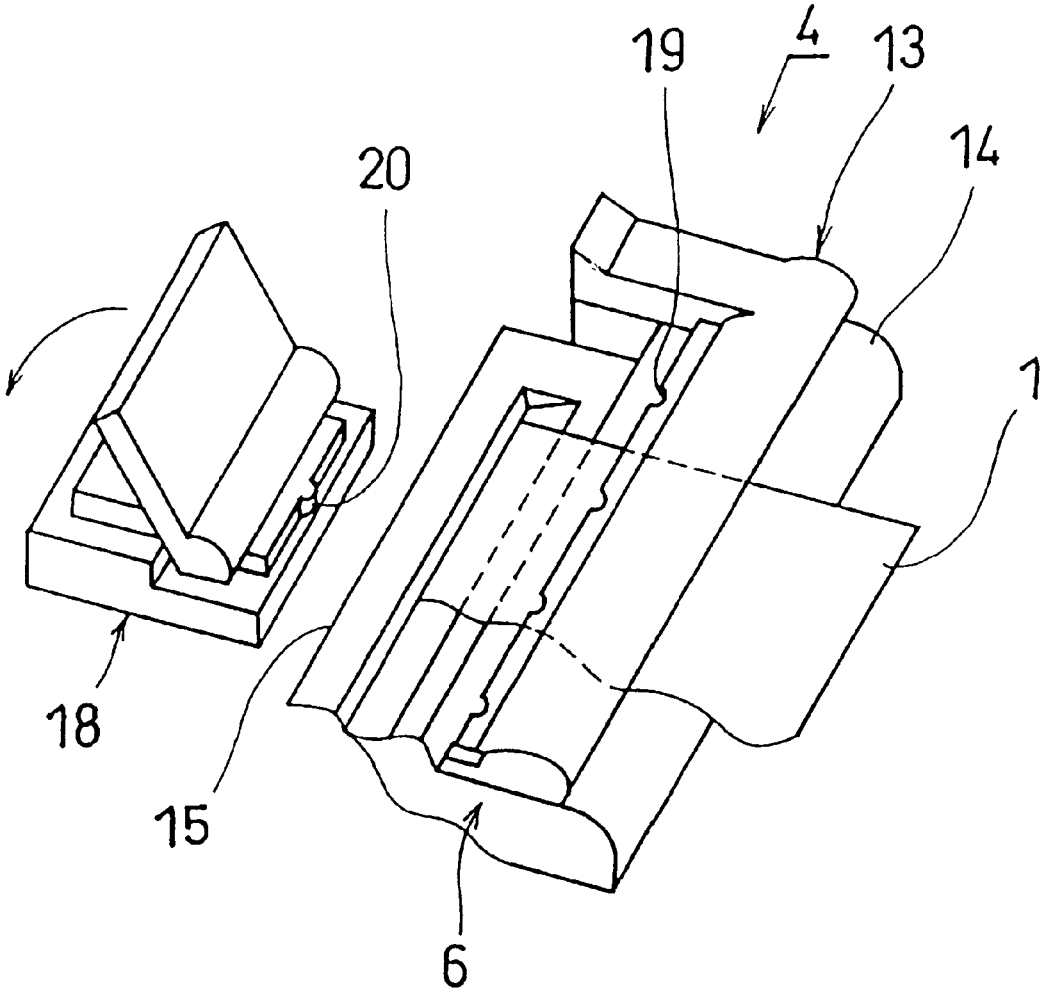
FIG.46 (Prior Art)
FIG. 46 is a perspective view showing that a conventional binding apparatus punches the papers.

Hereinafter, the binder setting portion 24 is turned toward a back side of the putting member 22 around shafts in the bearing holes 29 and make the ends of the papers 1 projected from the front edge of the putting member 22. And as shown in FIG. 46 of a conventional art, the punch 18 is positioned by fitting the projection 20 in the recessed portions 19 of the punch guide plate 37 of the holding portion 25 and the holes 5 are punched in turn while moving the punch 18 by sliding along the punch guide plate 37.

Figure 36:
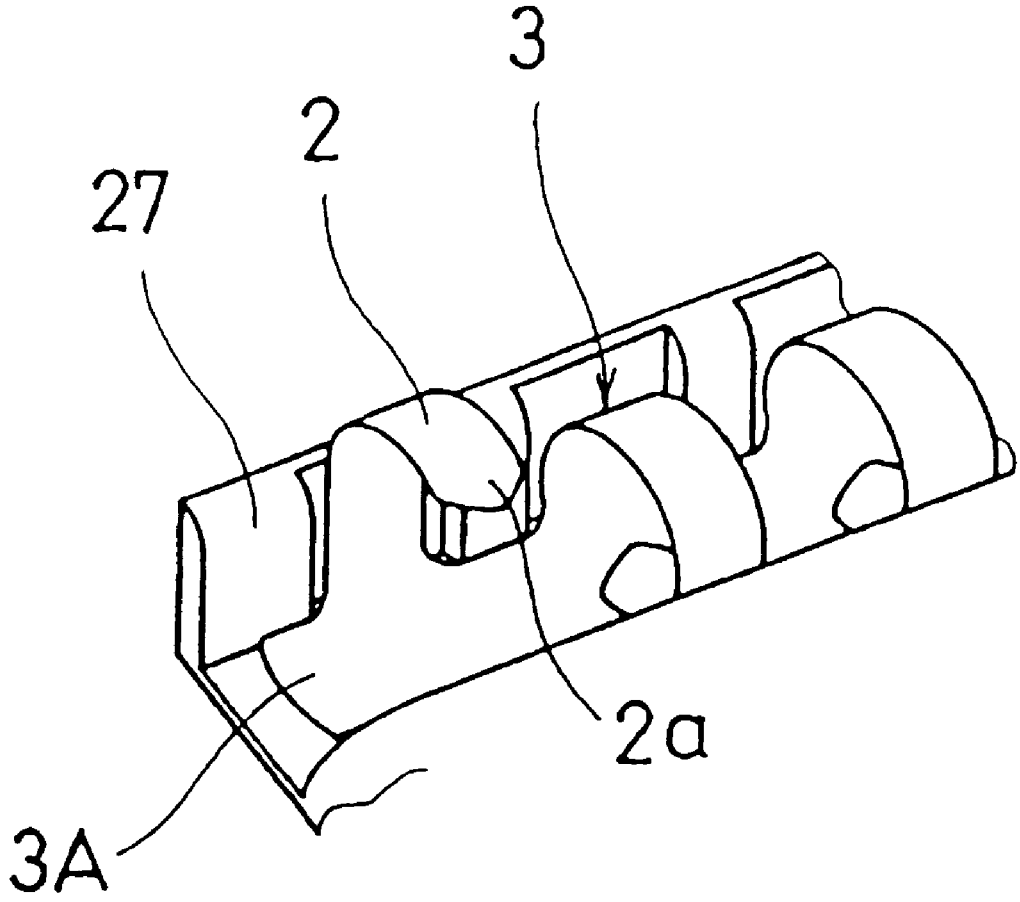
FIG. 36 is a partially enlarged sectional view showing the direction of the ring binder setting portion.

Next, a case where the punched papers 1 are bound with the ring binder 3 is explained. First, as shown in FIG. 20, the binder setting portion 24 is returned to the original position where it is not turned, the ring binder 3 is set in the groove portion 26 as shown in FIG. 36. In this case, make the ring pieces 2*a* of the curl ring 2 is adapted to be positioned at the side of the putting member 22 as shown in FIG. 36, at which time the ring binder 3 is easily positioned in the groove portion 26 while the curl ring 2 and the positioning projection 27 are smoothly fitted. At that time, the punched papers 1 are once removed.

Figure 37:
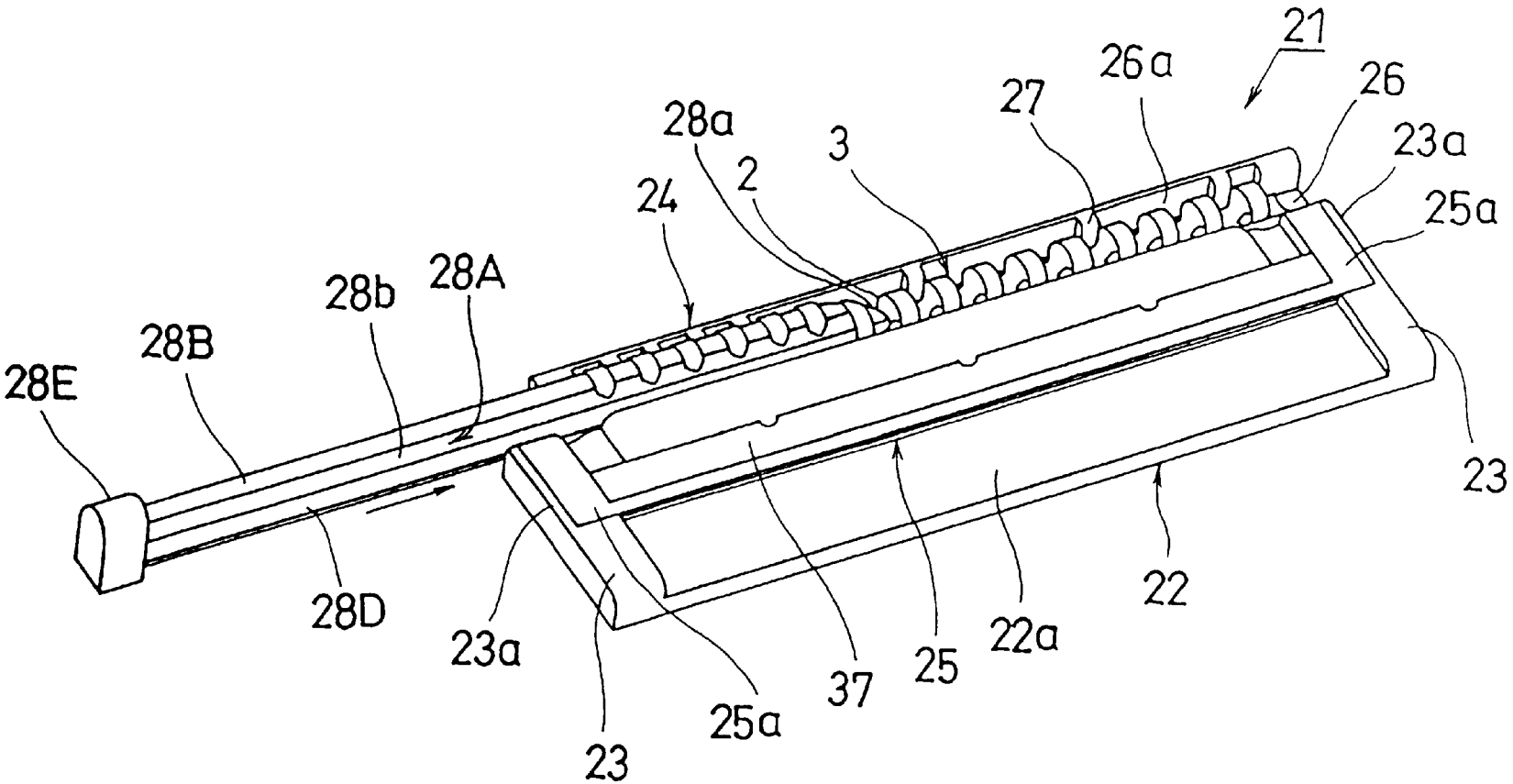
FIG. 37 is a perspective view showing that the opening/closing bar opens the curl ring disposed in the binder setting portion of the auxiliary device and binding the papers shown in FIG. 35.
Figure 38:
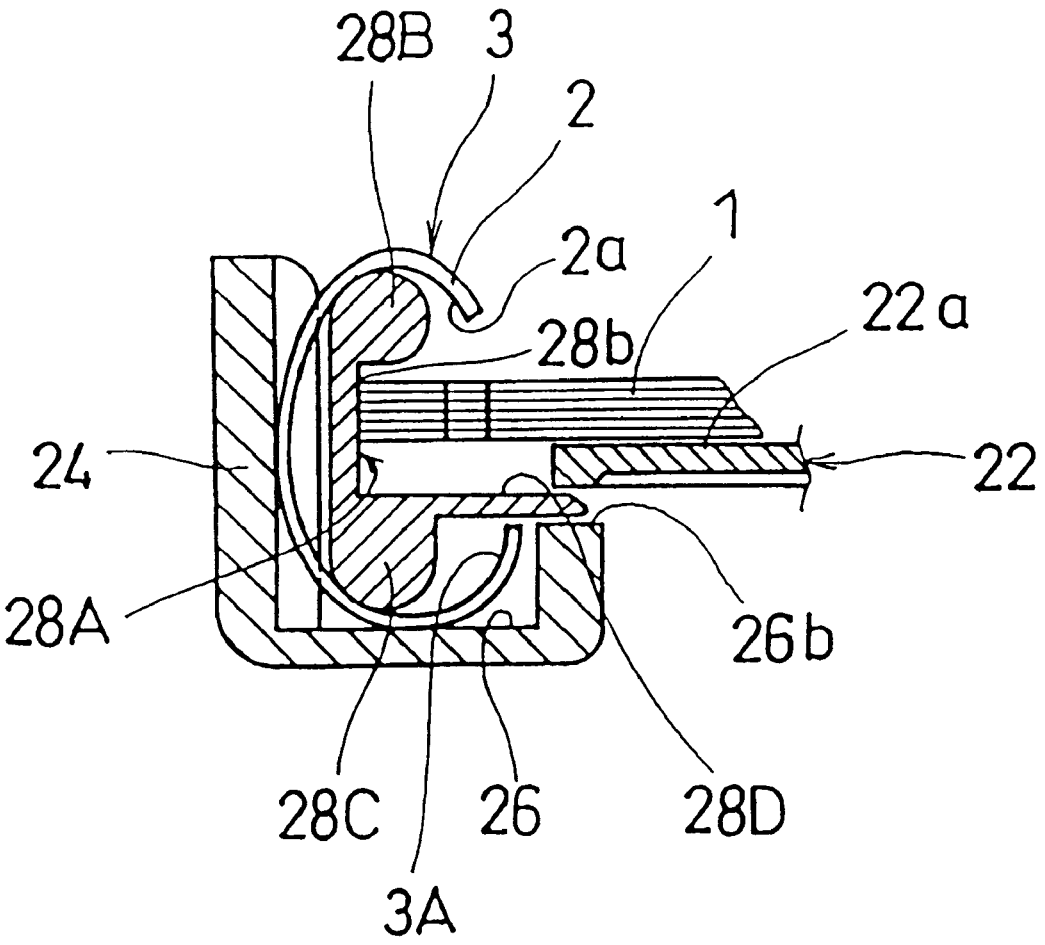
FIG. 38 is a sectional view showing the state where the opening/closing bar opens the curl ring of the ring binder disposed in the binder setting portion of the auxiliary device for binding.
Figure 39:
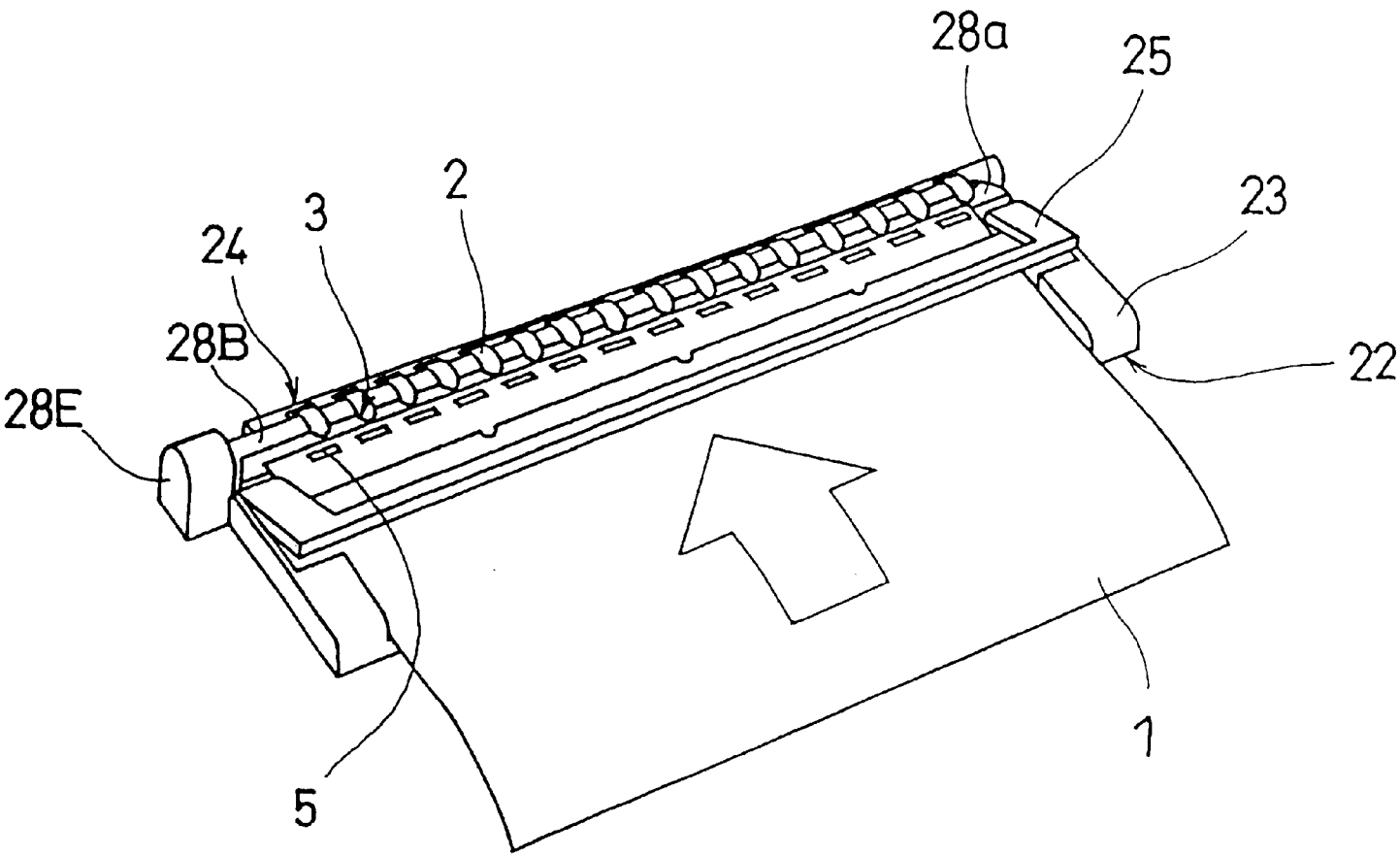
FIG. 39 is a perspective view showing that the opening/closing bar opens the ring pieces to fit these in the holes of the papers.

After the ring binder 3 is positioned, the opening/closing bar 28A is inserted in the curl ring 2, as shown in FIG. 37. The guide plate 28D of the opening/closing bar 28A is inserted between an upper end of the other side wall 26*b* of the groove portion 26 and a lower surface of the front edge of the plane portion 22*a* of the putting member 22 and positioned. Thereby, the opening/closing bar 28A is guided securely when it is slid.

Further, since the swollen portions 28B and 28C are provided on both sides of the opening/closing bar 28A, it slides easily in the curl ring 2 and the base portion 3A and the ring pieces 2*a* of the curl ring 2 are opened easily departing from the base portion 3A.

Figure 40:
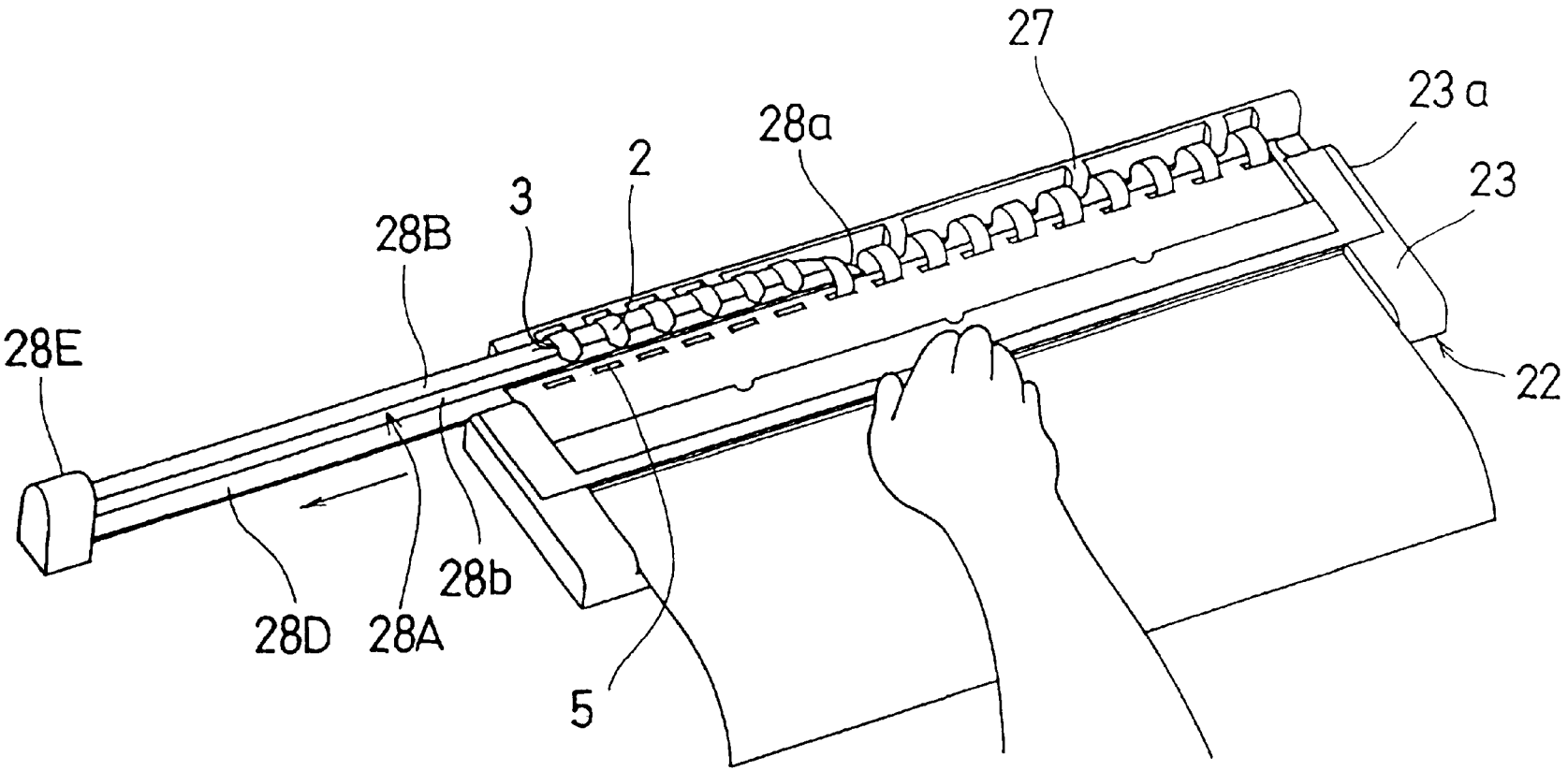
FIG. 40 shows that the opening/closing bar is being pulled out-while arranging the papers with hand.

After the ring pieces 2*a* are opened, the punched papers 1 which are once removed are pushed by putting the on the putting member 22 in an arrow direction and abutted against the opening/closing bar 28A, as a result, the holes 5 of the papers 1 and the ring pieces 2*a* are made to be corresponded each other and clamped tightly with the holding portion 25 and the putting member 22. Further, as shown in FIG. 40, the opening/closing bar 28A is pulled out while holding the auxiliary device 21 with a hand preventing it from moving. Thereby, the ring pieces 2*a* are inserted in the holes 5 of the papers 1 to bind the papers 1.

At the time of binding the papers 1 in the ring binder 3 and removing the ring binder 3 from the papers 1, the positioning of the papers 1 can be carried out by positioning the ends of the papers 1 on the upper side of the guide plate 28D or making the papers 1 abutted against the opening/closing bar 28A so as to putf the papers 1 on the guide plate 28D. Further, the ring pieces 2*a* of the curl ring 2 can be positioned at the inside of the basic portion 3A by the guide plate 28D when the curl ring 2 is closed by pulling out the opening/closing bar 28A from the ring binder 3. In order to secure such operation, the diameter of the lower swollen portion 28C in section may be set larger than the upper swollen portion 28B.

Thus, the papers 1 binding operation was explained, but when removing the ring binder 3 from the papers 1, a reverse process of the above may be employed. That is, the ring binder is made to be set in the groove portion 26 of the binder setting portion 24 while making the ring binder 3 located in the direction identical with the time of binding the papers 1. And, while holding the ring binder 3, the papers 1 are drawn a little so as to make the opening/closing bar 28A enabled to be easily inserted in the curl ring 2.

Subsequently, the opening/closing bar 28A is inserted in the curl ring 2 while positioning the guide plate 28D of the opening/closing bar 28A between the putting member 22 and the upper end of the other side wall 26*b* of the groove portion 26. Thereby, the curl ring is opened to take out the papers 1. Then, the opening/closing bar 28A may be pulled out from the curl ring 2.

Although the auxiliary device 21 as an auxiliary tool for the above opening/closing bar 28A is constituted in general from the putting member 22 for putting the papers 1, the holding portion 24 for papers 1 and the binder setting portion 24 contributing for both positioning the papers 1 and setting the ring binder 3, a binder setting device can be solely set independently which function as setting the binder ring 3.

In this case, a guide portion (for example a recessed portion provided on the wall portion or a fitting gap formed between an upper end of the wall portion and other member) for guiding the guide plate 28D of the opening/closing bar 28A can be preferably provided.

Figure 41:
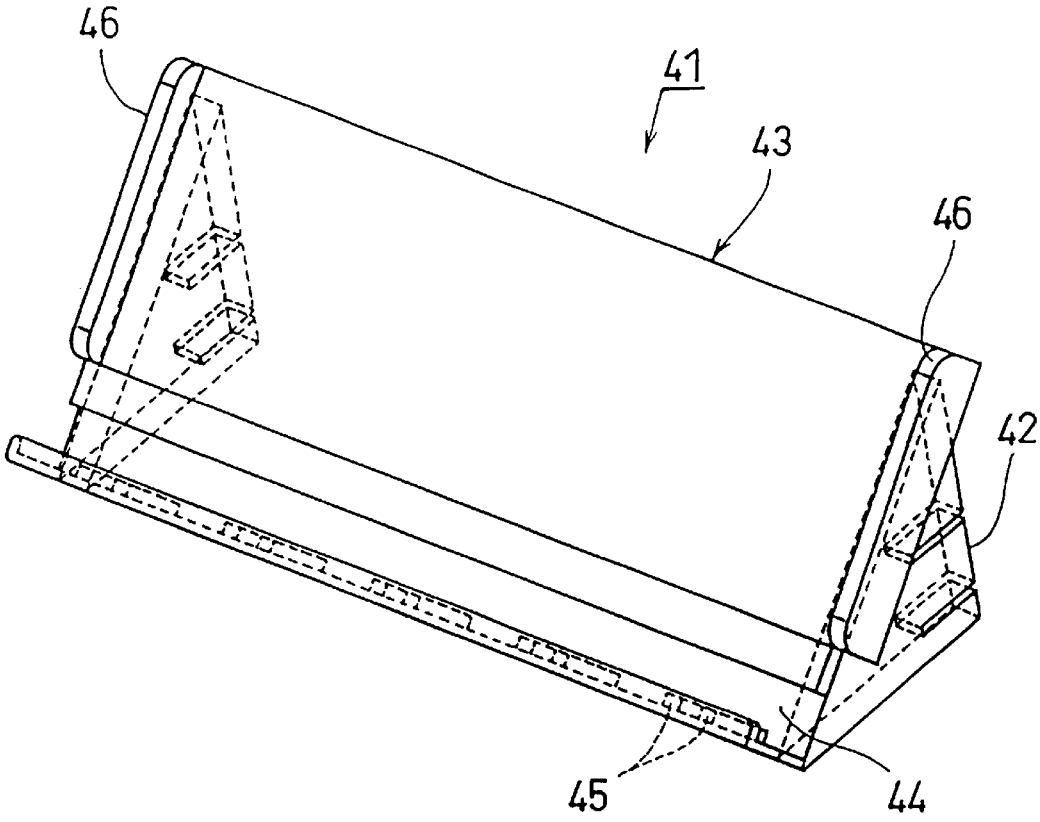
FIG. 41 is a perspective view showing another embodiment of the binder setting device.
Figure 42:
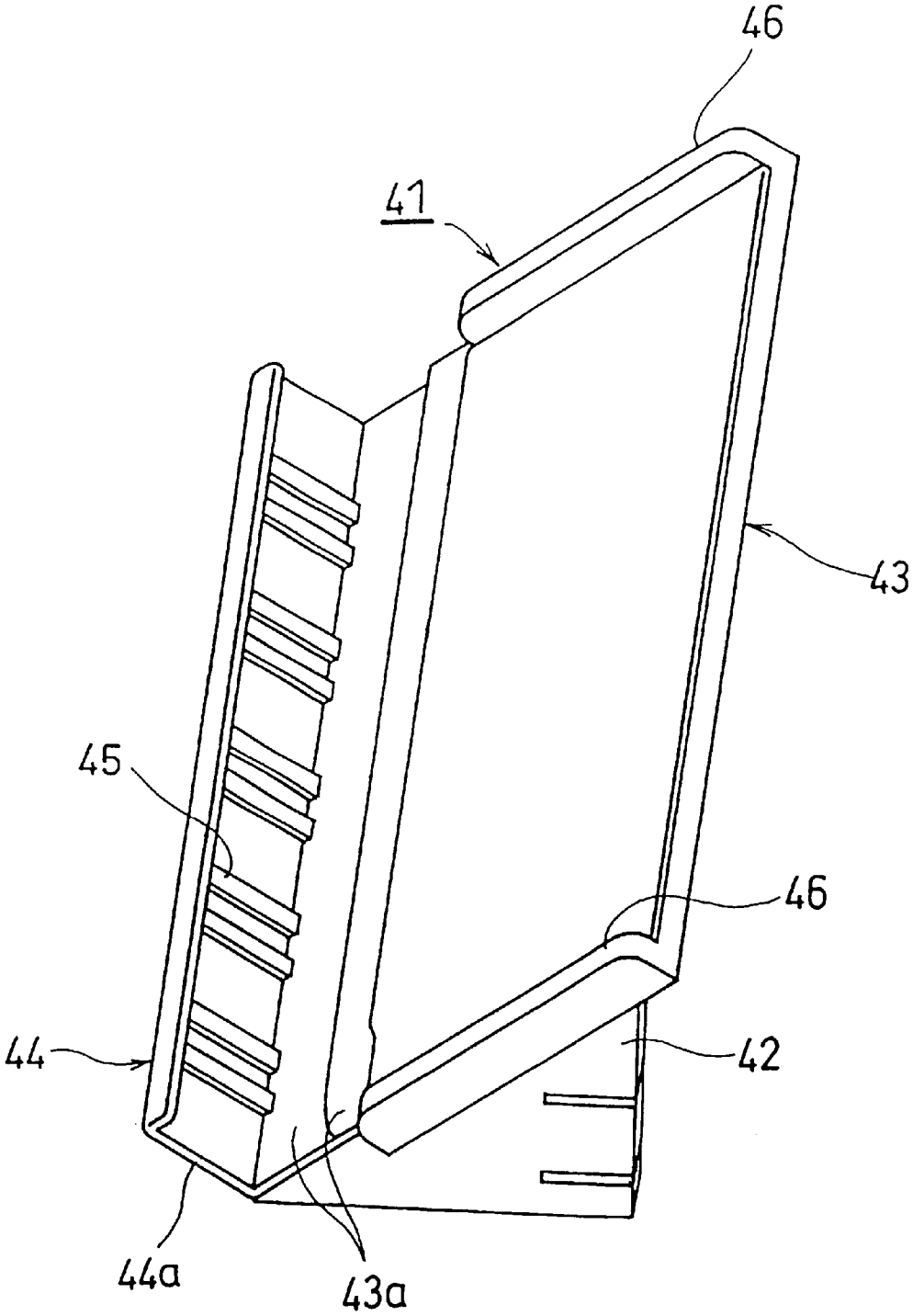
FIG. 42 is a perspective view of FIG. 41.
Figure 43:
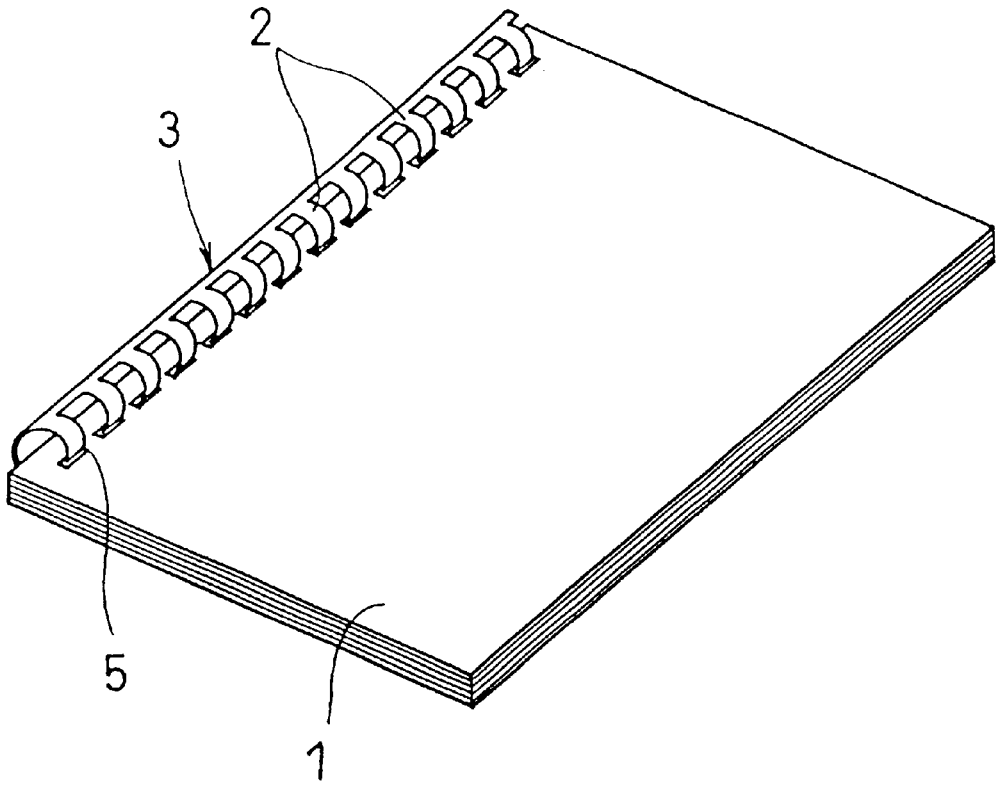
FIG. 43 (Prior Art)
FIG. 43 is a perspective view showing a conventional art in which the papers are bound with the ring binder.
Figure 44:
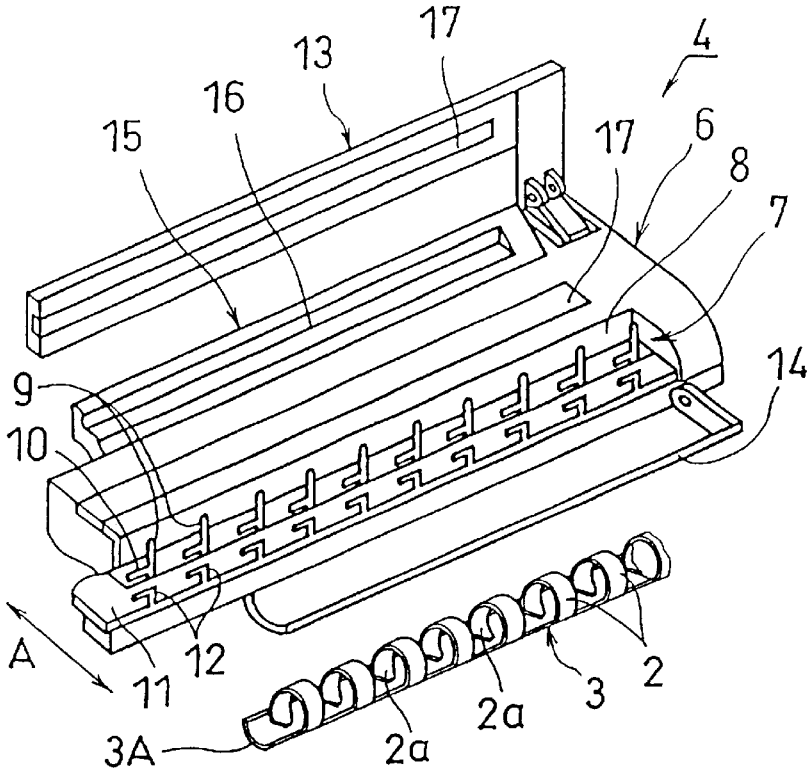
FIG. 44 (Prior Art)
FIG. 44 is a perspective view showing a conventional binding apparatus.
Figure 45:
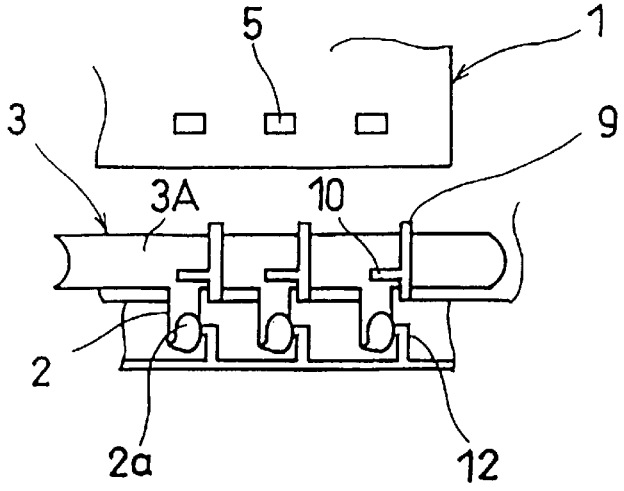
FIG. 45 (Prior Art)
FIG. 45 is a plan view showing a main part in which a conventional binding apparatus opens the curl ring of the ring binder.

Further, what is shown in FIGS. 41 and 42 is another binder setting device 41. This binder setting device 41 is structured by disposing a plate-like paper putting portion 43 on an inclined portion of a sectional triangular base stand 42, and on a front lower portion a binder setting portion 44 for the ring binder 3 is provided approximately perpendicular to the putting portion 43. The binder setting portion 44 is configured approximately L-letter shaped in a side view and at a bottomed position thereof a plural projections 45 for positioning are arranged at a given spacing. The positioning projections 45 are disposed in 5 rows of 2 rows. A front-lower portion of the putting portion 43 is formed in a stepped portion 43*a* so as to make the holes 5 of the papers 1 enabled easily to fit to the curl ring 2 of the ring binder 3 set on the binder setting portion 44, and below the stepped portion 43*a* one end side of the L-letter figured binder setting portion 44 is mounted.

Thereby, it becomes easier to insert the opening/closing bar 28A in the curl ring 2 of the ring binder 3 set on the binder setting portion 44. For reference, a sign 46 in FIGS. 41, 42 indicates a guide for the papers 1. And, such manners as the ring binder 3 is positioned on the binder setting portion 44 of the binder setting device 41 and makes the opened curl ring 2 inserted in the holes 5 of the papers 1 and as the ring binder 3 is made to be separated from the papers 1 bound by the ring binder 3 are approximately identical with the above and the explanation is omitted.

According to the first aspect of the present invention, since the opening/closing bar is formed with the introduction part on the tip end, when the opening/closing bar having this introduction part is inserted in the curl ring of the ring binder and in the base portion, the ring pieces of the curl ring is smoothly pushed up to open the curl ring easily.

Further, when curl ring is opened, the positioning of the papers is carried out by abutting the ends of the overlapped papers in plural number at the side of the holes against the side wall face of the opening/closing bar. And, when pulling out the opening/closing bar from the ring binder while facing the holes of the papers to the ring pieces of the curl ring, the curl ring is easily fitted in the holes of the papers to bind the papers.

And, when the ring binder to bind the papers is removed and separate the papers and ring binder, the papers are made to be positioned at the side of the ring pieces of the curl ring and the opening/closing bar is inserted in the ring binder, then the papers and ring binder is separated easily.

According to the second aspect of the present invention, since swollen portions are provided on both side ends in a longitudinal direction of the opening/closing bar respectively, when the opening/closing bar is inserted in the curl ring of the ring binder, the opening/closing bar can be slid smoothly along the longitudinal direction of the inner circumferences of the ring binder and the base portion. And, when the curl ring is opened by the opening/closing bar, the ends of the papers overlapped in plural number at the hole side are abutted to the side wall surface of the opening/closing bar to position the papers while facing the holes of the papers and the ring pieces of the curl ring. Then, if the opening/closing bar is pulled out from the ring binder, the ring pieces of the curl ring are fitted in the holes of the papers easily to bind the papers.

And, when the ring binder to bind the papers is removed and separate the papers and ring binder, the papers are made to be positioned at the side of the ring pieces of the curl ring and the opening/closing bar is inserted in the ring binder, then the papers and ring binder is separated easily.

According to the third aspect of the present invention, since the side wall face, on which the swollen portions are provided, is made linear in section along which the ring pieces are traced at the time of closing of the ring binder, if the ends of the papers are abutted against the linear portion at the hole side, the holes of the papers overlapped in plural number can be accorded with the moving trace of the ring pieces of the curl ring at the time of closing. Thereby, at the time of binding the papers, the curl ring is easily fitted in the holes of the papers.

And, when the ring binder to bind the papers is removed and separate the papers and ring binder, the papers are made to be positioned at the side of the ring pieces of the curl ring and the opening/closing bar the side wall face of which is configured linear in section is inserted in the ring binder, then the papers and ring binder is separated easily.

According to the fourth aspect of the present invention, since the guide plate is provided perpendicular to the side wall face of the opening/closing bar, when the opening/closing bar is inserted in the ring binder, the lower side of the guide plate touches the base portion of the ring binder to guide securely the opening/closing bar. Further, since the upper portion of the guide plate is used as the stand portion for supporting the ends of the papers at the time of fitting the curl ring in the holes of the papers, this stand portion and the opening/closing bar can position the papers securely. Thereby, the ring pieces of the curl ring can be easily inserted in the holes of the papers.

And, when the ring binder to bind the papers is removed and separate the papers and ring binder, the papers are made to be positioned at the side of the ring pieces of the curl ring and the guide plate of the opening/closing bar is positioned at the side the ring pieces side and the guide plate is inserted in the curl ring while supporting the lower most papers, then the papers and ring binder is separated easily.

According to the fifth aspect of the present invention, since the guide plate is extended perpendicular to the side wall face of the opening/closing bar, the ends of the papers are supported securely and the papers are positioned securely between the extended guide plate and the side wall face of the opening/closing bar.

According to the sixth aspect of the present invention, since the side wall face of the opening/closing bar on which the guide plate is provided is formed linear in section so as to be traced by the moving tip end of the ring pieces at the time of closing of the ring binder, the ends of the papers can be imbricated linearly by abutting the papers overlapped in plural number, when the ends of the papers overlapped in plural number are abutted to that sectionally liear portion, the ends of the papers can be imbricated linearly. Thereby, the imbricated holes of the papers are accorded with the movement of the ring pieces of the curl ring to fit the curl ring in the holes of the papers easily.

And, when the ring binder to bind the papers is removed to separate the papers from the ring binder, the papers are made to be positioned at the side of the ring pieces of the curl ring, the guide plate of the opening/closing bar the side wall face of which is formed obliquely linear in section is made to be positioned at the side of the ring pieces of the curl ring, the guide plate is inserted in the lower most papers so as to support the papers and the opening/closing bar is inserted in the curl ring, the papers and the ring binder are separated easily.

As described above, by using the opening/closing bar is having the introduction portion, the swollen portions and the guide plate, it is easy to open the ring binder not only to bind the papers with the ring binder, but also to separate the papers bound by the ring binder from the ring binder easily.

According to the seventh aspect of the present invention, since the front lower portion of the guide portion is provided rotatably with the binder setting portion, when punching the papers this binder setting portion is turned backside, and when binding the papers it is returned in original position. Then, by setting the ring binder on the binder setting portion, the positioning of the ring binder is carried out securely. Further, when the ring pieces are inserted in the curl ring of the ring binder set on the binder setting portion, the curl ring is opened easily. Accordingly, the apparatus for opening the ring binder ca be simplified and low-priced to avoid the complicated processes.

And, in order to separate the ring binder which binds the papers using the auxiliary device and the opening/closing bar and the papers, the papers and the ring pieces of the curl ring are made to be positioned at the side of the putting member of the auxiliary device and the ring binder is made to be positioned at the side of the above putting member, further the guide plate of the opening/closing bar is made to be positioned at the side of the putting member, and while inserting the guide plate under the lower most of the papers so as to support the papers, the opening/closing bar is made to be inserted in the curl ring of the ring binder, and thereby the papers and the ring binder are separated easily.

According to the eighth aspect of the present invention, since a plurality of positioning projections are provided on one side wall of the groove portion formed on the binder setting portion, when the ring pieces of the curl ring are made to be engaged with the projections, the ring binder is positioned securely, furthermore, since another side wall which forms a groove portion is formed lower than the one side wall, if the guide plate is contacted on another side wall, the opening/closing bar inserted in the curl ring is guided securely.

And, according to the ninth aspect of the present invention, since the intervals of the positioning projections provided on the groove portion are made narrower at the adjacent to the inserting opening of the opening/closing bar, the opening/closing bar can be inserted easily in the curl ring of the ring binder. After insertion, the ring binder is maintained at the widened projections and the opening/closing bar is guided securely.

According to the tenth aspect of the present invention, since the groove portion and the wall sides one of which is lower than the other are provided on the binder setting portion, the ring binder can be set on the groove portion and in addition the lower one can be a guide portion to be touched with the guide plate of the opening/closing bar. Accordingly, at the time of making the ring binder opened with this guide portion the opening/closing bar can be guided by the guide portion. As mentioned above, the ring binder is set on the binder setting device and in this ring binder the opening/closing bar is inserted to open easily the curl ring of the ring binder. Thereby, the papers are not only easily bound but also separated easily from the ring binder.

According to the eleventh aspect of the present invention, since, on both sides of the obliquely inclined putting member the papers guide portions are provided and on the front-lower portion of the putting portion the binder setting portion is provided perpendicular to the putting portion, the positioning of the papers put on the putting portion is carried out securely. Furthermore, since a plurality of positioning projections are provided on the binder setting portion, if with these positioning projections the curl ring of the ring binder is engaged, the ring binder is fixed on these and it is easily carried out to operate the opening/closing bar at the time of inserting the opening/closing bar in the ring binder or pulling out it from the ring binder. Accordingly, it is easily carried out to bind the papers with using the ring binder. In addition, if to this binder setting device the ring binder bound with the papers is set, it becomes easier to insert the opening/closing bar in the ring binder so to separate the papers bound in the ring binder and the ring binder.

What is claimed is:

1. An opening/closing bar rectangular in shape, to be inserted in a curl ring of a ring binder, the ring binder having a base portion and a plurality of ring pieces to be inserted in holes of papers to be bound, the opening/closing bar having a tapered introduction portion on a tip end of the rectangular shape bar, and swollen portions are provided on one side of the opening/closing bar wherein a side face of the swollen portions is formed linear in section which extends from an intersection between the side face and a lower swollen portion in a tangential line to a top of an upper swollen portion along a trace of the ring pieces when closing the curl ring.

2. An opening/closing bar rectangular in shape, to be inserted in a curl ring of a ring binder, the ring binder having a base portion and a plurality of ring pieces to be inserted in holes of papers to be bound, the opening/closing bar having a tapered introduction portion on a tip end of the rectangular shape bar, and swollen portions are provided on one side of the opening/closing bar wherein a guide plate is provided perpendicular to a side face of the swollen portions, and an upper surface of the guide plate is used as a stand for the papers and a lower surface of the guide plate is used as a guide during insertion of the opening/closing bar.

3. An opening/closing bar rectangular in shape, to be inserted in a curl ring of a ring binder, the ring binder having a base portion and a plurality of ring pieces to be inserted in holes of papers to be bound, the opening/closing bar having a tapered introduction portion on a tip end of the rectangular shape bar, and swollen portions are provided on one side of the opening/closing bar, wherein a side face of the swollen portions is formed linear in section which extends from an intersection between the side face and a lower swollen portion in a tangential line to a top of an upper swollen portion along a trace of the ring pieces when closing the curl ring and a side face of the swollen portions is formed linear in section which extends from an intersection between the side face and a guide plate in a tangential line to the top of an upper swollen portion along a trace of the ring pieces when closing the curl ring.

4. A binding apparatus formed in combination with an auxiliary device, in which guide members are provided on both sides of a plate-like paper putting portion integrally, at a front-lower portion of the guide members to which a part of a binder setting portion for positioning a ring binder faces the binder setting portion is mounted rotatably, at a front upper portion of the guide member a holding portion for holding papers put on the putting portion is arranged, and an opening/closing bar for opening a curl ring of the ring binder set on the ring binder setting portion of the auxiliary device.

5. A binding apparatus according to claim 4, wherein a groove portion is provided in the binder setting portion for setting the ring binder along a front edge of the putting member, and on one side wall of the groove portion a plurality of positioning projections for being engaged with the curl ring of the ring binder are provided at a given interval, and an other side wall of the groove portion is formed lower than the one side wall and an upper end of the other side wall is made to be a guide portion for a guide place of the opening/closing bar.

6. A blinding apparatus according to claim 5, wherein intervals of the positioning projections provided on one side wall of the groove portion are narrower close to an entrance of inserting the opening/closing bar and more wider from an area passing narrower portion.

7. A binding apparatus formed in combination with an auxiliary device which comprises a plate-like paper putting member, a binder setting portion for positioning a ring binder is provided at a bottom portion of the putting member approximately perpendicular thereto and a binder setting device formed with a plurality of projections for being engaged with the ring binder, and an opening/closing bar to open a curl ring of the ring binder set in a ring binder setting portion.

8. An opening/closing bar rectangular in shape, to be inserted in a curl ring of a ring binder, the ring binder having a base portion and a plurality of ring pieces, the opening/closing bar having a longitudinal side longer than a length of the curl ring and a short side having a dimension larger than a diameter of the curl ring and sufficient for making a gap between the base portion and tips of ring pieces when the opening/closing bar is inserted in the curl ring enabling inserted papers to be bound, and an introduction portion formed by being tapered or rounded on the tip end of the opening/closing bar, wherein a guide plate is provided perpendicular to a side face of the swollen portions, and an upper surface of the guide plate is used as a stand for the papers and a lower surface of the guide plate is used as a guide during insertion of the opening/closing bar.

9. An opening closing bar rectangular in shape, to be inserted in a curl ring of a ring binder, the ring binder having a base portion and a plurality of ring pieces to be inserted in holes of papers to be bound, the opening/closing bar having a tapered introduction portion on a tip end of the rectangular shape bar, and swollen portions are provided on one side of the opening/closing bar wherein a guide plate is provided perpendicular to a side face of the swollen portions, and an upper surface of the guide plate is used as a stand for the papers and a lower surface of the guide plate is used as a guide during insertion of the opening/closing bar.

10. An opening/closing bar rectangular in shape, to be inserted in a curl ring of a ring binder, the ring binder having a base portion and a plurality of ring pieces to be inserted in holes of papers to be bound, the opening/closing bar having a tapered introduction portion on a tip end of the rectangular shape bar, and swollen portions are provided on one side of the opening/closing bar, wherein a side face of the swollen portions is formed linear in section which extends from an intersection between the side face and a lower swollen portion in a tangential line to a top of an upper swollen portion along a trace of the ring pieces when closing the curl ring and a guide plate is provided perpendicular to the side face, and an upper surface of the guide plate is used as a stand for the papers and a lower surface of the guide plate is used as a guide during insertion of the opening/closing bar.

11. An opening/closing bar rectangular in shape, to be inserted in a curl ring of a ring binder, the ring binder having a base portion and a plurality of ring pieces to be inserted in holes of papers to be bound, the opening/closing bar having a tapered introduction portion on a tip end of the rectangular shape bar, and swollen portions are provided on one side of the opening/closing bar, wherein a guide plate is provided perpendicular to a side face of the swollen portions, and an upper surface of the guide plate is used as a stand for the papers and a lower surface of the guide plate is used as a guide during insertion of the opening/closing bar and the side face of the swollen portions is formed linear in section which extends from an intersection between the side face and the guide plate in a tangential line to a top of an upper swollen portion along a trace of the ring pieces when closing the curl ring.

* * * * *